US007526225B2

(12) United States Patent
Fukuta

(10) Patent No.: US 7,526,225 B2
(45) Date of Patent: Apr. 28, 2009

(54) DEVELOPING APPARATUS AND ASSEMBLY METHOD OF DEVELOPING APPARATUS

(75) Inventor: Hiroya Fukuta, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 1 day.

(21) Appl. No.: 11/863,862

(22) Filed: Sep. 28, 2007

(65) Prior Publication Data

US 2008/0025766 A1 Jan. 31, 2008

Related U.S. Application Data

(62) Division of application No. 11/190,204, filed on Jul. 27, 2005, now Pat. No. 7,292,802.

(30) Foreign Application Priority Data

Jul. 29, 2004 (JP) ..... 2004-222536
Jul. 29, 2004 (JP) ..... 2004-222538

(51) Int. Cl.
*G03G 15/08* (2006.01)

(52) U.S. Cl. ..... 399/103; 399/105; 399/111; 399/119

(58) Field of Classification Search ..... 399/103, 399/105, 111, 119
See application file for complete search history.

(56) References Cited

U.S. PATENT DOCUMENTS 5,697,021 A 12/1997 Watanabe et al.
6,002,898 A 12/1999 Yokomori et al.
6,032,002 A 2/2000 Yokomori et al.
6,212,343 B1 4/2001 Hosokawa et al.
6,256,467 B1 7/2001 Yokomori et al.
6,314,255 B1 11/2001 Yokomori et al.
6,336,015 B1 1/2002 Numagami
6,356,723 B1 3/2002 Sato et al.
6,496,669 B2 12/2002 Sato et al.
6,721,520 B2 4/2004 Higeta et al.
2003/0118364 A1 6/2003 Kamimura
2003/0231904 A1 12/2003 Choi et al.
2006/0024084 A1 2/2006 Fuwazaki et al.
2006/0024085 A1 2/2006 Sato et al.

FOREIGN PATENT DOCUMENTS

JP 2000075657 3/2000
JP 200160040 3/2001

OTHER PUBLICATIONS

EP Search Report in Application No. EP05016467 dated Feb. 2, 2006.

*Primary Examiner*—David M. Gray
*Assistant Examiner*—Geoffrey T Evans
(74) *Attorney, Agent, or Firm*—Banner & Witcoff, Ltd.

(57) ABSTRACT

The blade back seal, which integrally comprises the side portions extending in the vertical direction at the longitudinal end portions of the leaf spring member and the connecting portion for connecting the side portions at the longitudinal center portion of the leaf spring member, is interposed between the leaf spring member of the blade unit and the front attachment portion of the blade attachment member. At the opening of the case, the upper seal is interposed between the plate-like upper attachment portion, which extends in the longitudinal direction of the opening and has a width in the anteroposterior direction, and the extended portion of the bend preventing member of the blade unit, for sealing the space there between.

4 Claims, 22 Drawing Sheets

DEVELOPING APPARATUS AND ASSEMBLY METHOD OF DEVELOPING APPARATUS

CROSS-REFERENCE TO RELATED APPLICATIONS

This application is a Divisional application of co-pending U.S. application Ser. No. 11/190,204, filed Jul. 27, 2005, which was a Nonprovisional application claiming priority under 35 U.S. C. §119(a) on Patent Applications No. 2004-222536 filed in Japan on Jul. 29, 2004 and No. 2004-222538 filed in Japan on Jul. 29, 2004, the entire contents of which are hereby incorporated by reference.

BACKGROUND

The present invention relates to a developing apparatus, and an assembly method of a developing apparatus.

In an image forming apparatus such as a laser printer, an electrostatic latent image is formed on the surface of a photoconductor drum and developer is supplied to the electrostatic latent image from a developing apparatus, so that a developer image is retained on the surface of the photoconductor drum. The developer image is then transferred to a paper sheet, so that formation of an image on the paper sheet is achieved.

A developing apparatus comprises: a case having an opening faced to the photoconductor drum; a developing roller for retaining developer which is held in the case, and a blade (layer thickness regulating member) for regulating the layer thickness of developer to be retained by the developing roller. The developing roller is supported so as to be rotatable with a portion of the surface thereof being exposed at the opening of the case. The blade is formed to have a sheet-like shape extending in the axial direction of the developing roller, in which the upper end portion thereof is supported by the case and the lower end portion is welded by pressure welding at the surface of the developing roller. The developer in the case is supplied onto the surface of the developing roller, carried between the blade and the surface of the developing roller with the rotation of the developing roller and retained on the surface of the developing roller as a thin layer having a constant thickness. The developer retained on the surface of the developing roller is supplied to the electrostatic latent image formed on the surface of the photoconductor drum when the developer comes in contact with the surface of the photoconductor drum.

In such a developing apparatus, the developer in the case might enter the back surface (face opposite to the opposed face which is opposed to the developing roller) of the blade, run round from the back surface to the upper end portion of the blade and leak from between the upper end portion of the blade and the case. Therefore, a conventional image forming apparatus is provided with a plurality of seals, which are provided at the back surface of the blade, for preventing leakage of developer which runs round from the back surface of the blade. That is, since a clearance is generated between the seal and the back surface of the blade at a portion of a step to be formed by the back surface of the blade and a support portion, which is arranged at the back surface of the blade for supporting the blade, when the seal is arranged astride the step, a plurality of seals are arranged so as not to be formed astride the step (see Japanese Patent Application Laid-Open No. 2001-60040, for example). Moreover, a conventional image forming apparatus is provided with a blade back sealing member, which is provided at the back surface of the blade, for preventing leakage of developer which runs round from the back surface of the blade (see Japanese Patent Application Laid-Open No. 2000-75657, for example).

SUMMARY

However, since each seal needs to be arranged accurately in order to reliably prevent leakage of developer which runs round from the back surface of the blade, the arrangement of seals takes a lot of trouble. In recent years, the dimension of a developing apparatus is required to be decreased heightwise (in the vertical direction) in order to downsize an image forming apparatus. In order to decrease the dimension of a developing apparatus heightwise, the dimension of the blade needs to be decreased heightwise and, therefore, the dimension of the blade back sealing member needs to be decreased heightwise. However, when the dimension of the blade back sealing member is decreased heightwise, the seal width at the back surface of the blade is decreased heightwise and the sealing performance lowers, and there arises a problem that the developer which runs round from the back surface of the blade tends more to leak.

An object is to provide: a developing apparatus and a process cartridge capable of reducing the trouble of arranging a sealing member; and an image forming apparatus comprising such a developing apparatus or a process cartridge.

Another object is to provide: a developing apparatus and a process cartridge capable of reliably preventing leakage of developer from between a case and a layer thickness regulating member even when the dimension of the layer thickness regulating member is decreased heightwise (in the opposed direction of a first wall portion and a developer retainer); and an image forming apparatus comprising such a developing apparatus or a process cartridge.

Yet another object is to provide an assembly method of a developing apparatus capable of reliably preventing leakage of developer from between a case and a layer thickness regulating member even when the dimension of the layer thickness regulating member is decreased heightwise (in the opposed direction of a first wall portion and a developer retainer).

A developing apparatus of the first aspect comprises: a case having a slit-shaped opening and a holder, which communicates with the opening, for holding developer; a wall portion which is provided at the case and extends along a longitudinal direction of the opening, perpendicular to a communication direction between the opening and the holder; a developer retainer which is arranged along the longitudinal direction of the opening and supported at a side of the wall portion opposite to the holder in the communication direction so as to be rotatable; a blade, which is arranged along the wall portion between the wall portion and the developer retainer and has a first end portion side that is one end arranged opposite to the wall portion and a second end portion side that is the other end pressing the developer retainer, for regulating a layer thickness of developer to be retained by the developer retainer; a supporting member, which is arranged at an opposed face of the blade that is opposed to the wall portion, for supporting the blade; and a sealing member, which is arranged at the opposed face so as not to be overlapped with the supporting member and integrally has side portions respectively extending in a direction perpendicular to the longitudinal direction at longitudinal end portions of the blade and a connecting portion connecting the side portions at a longitudinal center portion, for sealing a space between the wall portion and the blade.

The side portions of the sealing member make it possible to prevent leakage of developer from between the longitudinal end portions of the blade and the wall portion of the case. Moreover, the connecting portion of the sealing member makes it possible to prevent leakage of developer from between the longitudinal center portion of the blade and the wall portion of the case. It is therefore possible to prevent leakage of developer from between the longitudinal entire area of the blade and the wall portion. Furthermore, since the sealing member is arranged so as not to be overlapped with the supporting member and a clearance is not generated on the opposed face of the blade, it is possible to reliably seal the space between the blade and the wall portion of the case. Moreover, since the side portions and the connecting portion of the sealing member are formed integrally, one sealing member is enough and arrangement at the opposed face of the blade which is opposed to the wall portion can be achieved accurately and simply. It is therefore possible to reduce the trouble of arranging the sealing member.

A developing apparatus of the second aspect comprises: a case having a slit-shaped opening and a holder, which communicates with the opening, for holding developer; a wall portion which is provided at the case and extends along a longitudinal direction of the opening, perpendicular to a communication direction between the opening and the holder; a developer retainer which is arranged along the longitudinal direction of the opening and supported at a side of the wall portion opposite to the holder in the communication direction so as to be rotatable; a blade, which is arranged along the wall portion between the wall portion and the developer retainer and has a first end portion side that is one end arranged opposite to the wall portion and a second end portion side that is the other end pressing the developer retainer, for regulating a layer thickness of developer to be retained by the developer retainer; a supporting member, which is arranged at an opposed face of the blade that is opposed to the wall portion, for supporting the blade; a sealing member, which is arranged at the opposed face with a portion being overlapped with the supporting member, for sealing a space between the wall portion and the blade; and elastic adhesive, which is applied to a step portion to be formed by longitudinal end portions of the supporting member and the opposed face of the blade, for sealing a clearance generated by the step portion and the sealing member. Although the sealing member and the supporting member are arranged to be overlapped and a clearance is generated on the opposed face of the blade, it is possible to reliably seal the space between the blade and the wall portion of the case since the clearance is filled with the elastic adhesive. Moreover, one sealing member is enough and arrangement at the opposed face of the blade which is opposed to the wall portion can be achieved accurately and simply.

A developing apparatus of the third aspect comprises: a case having a slit-shaped opening and a holder, which communicates with the opening, for holding developer; a first wall portion which is provided at an end of the opening along a longitudinal direction, extends along the longitudinal direction and extends along a communication direction between the opening and the holder; a developer retainer, which is arranged at the opening along the longitudinal direction of the opening and supported at the case so as to be rotatable, for retaining developer; a layer thickness regulating member, which has one end arranged opposite to the first wall portion, extends from said one end toward a surface of the developer retainer and has the other end pressing the developer retainer, for regulating a layer thickness of developer to be retained by the developer retainer; and a first sealing member, which is interposed between the first wall portion and the layer thickness regulating member, for sealing a space between the first wall portion and the layer thickness regulating member.

The first sealing member interposed between the layer thickness regulating member and the first wall portion provided at the case makes it possible to prevent leakage of developer from between the case and the layer thickness regulating member. The layer thickness regulating member extends from one end at the first wall portion side to the developer retainer, between the first wall portion, which is provided at one end along the longitudinal direction of the opening of the case, and the developer retainer arranged at the opening. That is, the layer thickness regulating member is arranged between the first wall portion and the developer retainer so as to extend in the opposed direction of the first wall portion and the developer retainer. Since the first sealing member is interposed between the first wall portion and one end of the layer thickness regulating member arranged as described above, the dimension of the first sealing member does not need to be decreased even when the dimension of the layer thickness regulating member is decreased (heightwise) in order to decrease the dimension of the developing apparatus in the opposed direction of the first wall portion and the developer retainer. As a result, it is possible to ensure the sealing performance by the first sealing member, to reliably prevent leakage of developer from between the case and the layer thickness regulating member and to downsize the developing apparatus.

An assembly method of a developing apparatus of the fourth aspect is an assembly method of a developing apparatus comprising: a case having a split-shaped opening and a holder, which communicates with the opening, for holding developer; a developer retainer, which is arranged at the opening along a longitudinal direction of the opening and supported at the case so as to be rotatable, for retaining developer; and a layer thickness regulating member for pressing the developer retainer and regulating a layer thickness of developer to be retained by the developer retainer, wherein the developing apparatus comprises; a first wall portion which is provided at an end of the opening along a longitudinal direction, extends along the longitudinal direction and extends along a communication direction between the opening and the holder; a first sealing member, which is interposed between the first wall portion and the layer thickness regulating member, for sealing a space between the first wall portion and the layer thickness regulating member; a second wall portion which is provided at the case so as to extend along the longitudinal direction of the opening, perpendicular to the communication direction, and is arranged opposite to the layer thickness regulating member; and a second sealing member, which is interposed between the second wall portion and the layer thickness regulating member, for sealing a space between the second wall portion and the layer thickness regulating member, and the layer thickness regulating member comprises: a blade, which is formed to have a sheet-like shape extending in a longitudinal direction of the opening and has one end arranged opposite to the first wall portion and the other end pressing the developer retainer; a first supporting member, which is arranged along one face of the blade, for supporting the blade at the first wall portion side; and a second supporting member, which has one face in contact with a face of the blade opposite to a face where the first supporting member is provided and the other face opposite to said one face in contact with the second wall portion and is arranged with a distance from the first wall portion, said assembly method comprising the steps of arranging the first sealing member and the second sealing member respectively in contact with the first wall portion and the second wall portion;

and then attaching the layer thickness regulating member to the case from a direction in which the first sealing member is pressed to the first wall portion by the first supporting member and the second sealing member is pressed to the second wall portion by the first supporting member.

With such a method, since the layer thickness regulating member is attached to the case so that the first supporting member presses the first sealing member to the first wall portion and the first supporting member presses the second sealing member to the second wall portion, said other face of the second supporting member can be made in contact with the second wall portion and the second sealing member can be arranged between the second supporting member and the first wall portion. It is therefore possible to prevent engagement of the second sealing member between the second supporting member and the second wall portion.

The above and further objects and features of the invention will more fully be apparent from the following detailed description with accompanying drawings.

DETAILED DESCRIPTION OF THE EXEMPLARY EMBODIMENTS

Figure 1:
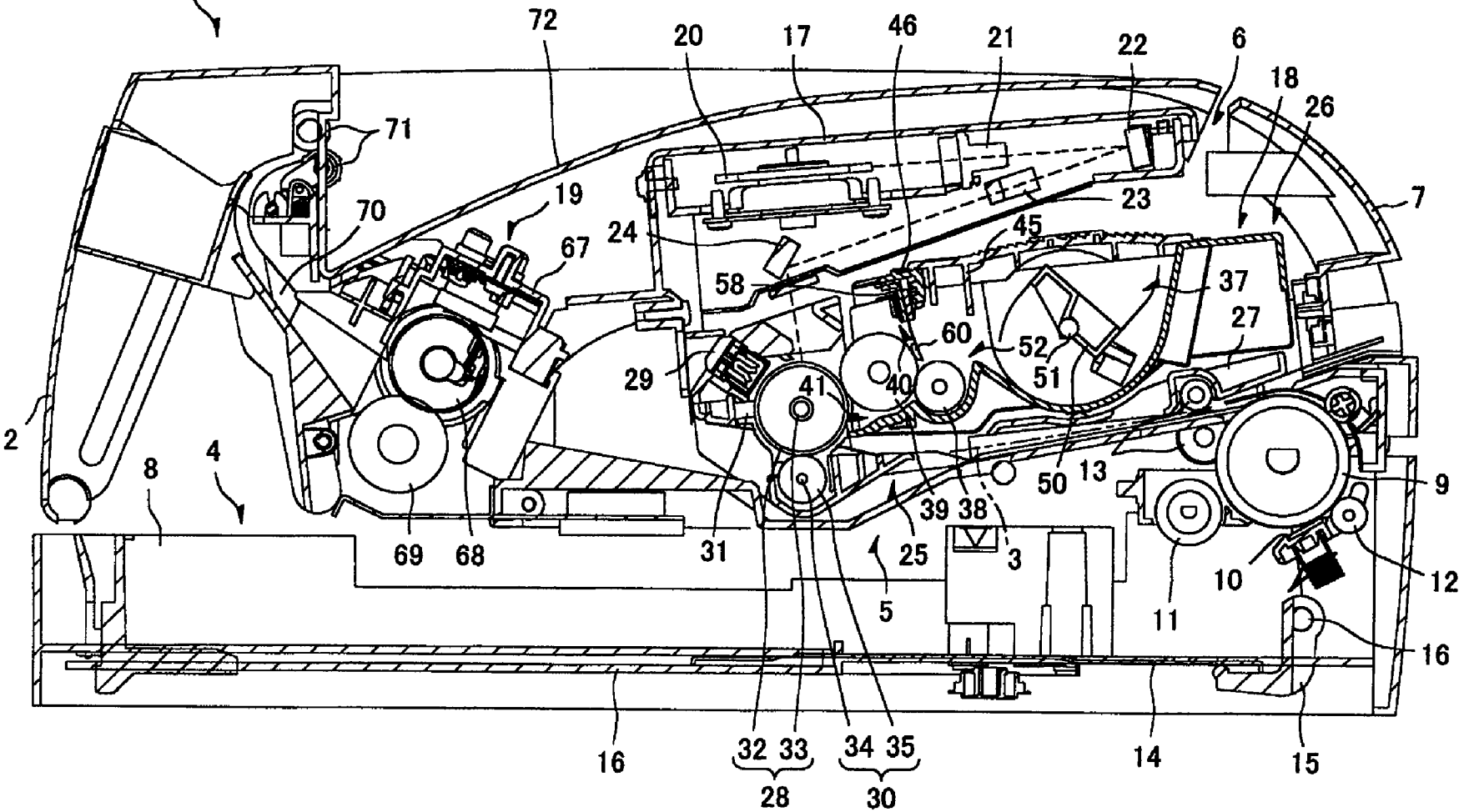
FIG. 1 is an essential part sectional side view showing an embodiment of a laser printer which functions as an image forming apparatus.

FIG. 1 is an essential part sectional side view showing an embodiment of a laser printer which functions as an image forming apparatus. In FIG. 1, the laser printer 1 comprises a feeder unit 4 for feeding a paper sheet 3, an image forming unit 5 for forming an image on a fed paper sheet 3, and the like in a body casing 2.

On one sidewall of the body casing 2, an insertion port 6 for attaching and detaching a process cartridge 18, which will be explained later, is formed and a front cover 7 for opening and closing the insertion port 6 is provided. This front cover 7 is supported by a cover shaft (not illustrated in the figure) which is inserted into a lower end portion thereof, so as to be freely rotatable. Thus, the insertion port 6 is closed by the front cover 7 when the front cover 7 is closed around the cover shaft as the center while the insertion port 6 is opened when the front cover 7 is opened (tilted) around the cover shaft as the supporting point, so that the process cartridge 18 can be attached to or detached from the body casing 2 through this insertion port 6. Moreover, an operation panel (not illustrated in the figure) which comprises operation keys and an LED display unit is embedded in the front cover 7. It should be noted that a side of this laser printer 1 where the front cover 7 is provided will be hereinafter referred to as "front side" and the opposite side will be referred to as "back side".

The feeder unit 4 comprises: a paper feed tray 8 to be mounted detachably at the bottom portion in the body casing 2; a paper feed roller 9 and a paper feed pad 10 provided above a front end portion of the paper feed tray 8; a pickup roller 11 provided at the back side of the paper feed roller 9; a pinch roller 12 arranged opposite below the front side of the paper feed roller 9; and a resist roller 13 provided above the back side of the paper feed roller 9.

A paper pressing plate 14 is provided inside the paper feed tray 8 so that paper sheets 3 can be laid thereon in a laminated manner. This paper pressing plate 14 is supported at the back end portion thereof so as to be able to pivot, so that the front end portion can be moved in the vertical direction. Moreover, the front end portion of the paper feed tray 8 is provided with a lever 15 for lifting the front end portion of the paper pressing plate 14 upward. This lever 15 is formed to have a substantially L-shaped section so as to run round from the front side to the lower side of the paper pressing plate 14, and the upper end portion thereof is attached to a lever shaft 16 provided at the front end portion of the paper feed tray 8 and the back end portion thereof is in contact with the front end portion of the lower face of the paper pressing plate 14. Thus, when rotational driving force in the clockwise direction in the figure is inputted to the lever shaft 16, the lever 15 is rotated around the lever shaft 16 as the supporting point and the back end portion of the lever 15 lifts the front end portion of the paper pressing plate 14.

When the front end portion of the paper pressing plate 14 is lifted, the top paper sheet 3 on the paper pressing plate 14 is pressed by the pickup roller 11 and starts to be carried toward the space between the paper feed roller 9 and the paper feed pad 10 by the rotation of the pickup roller 11. On the other hand, when the paper feed tray 8 is detached from the body casing 2, the front end portion of the paper pressing plate 14 moves downward by its own weight and is made along the bottom face of the paper feed tray 8. In this state, paper sheets 3 can be laid on the paper pressing plate 14 in a laminated manner.

Paper sheets 3 sent toward the space between the paper feed roller 9 and the paper feed pad 10 by the pickup roller 11 are separated into respective sheets and fed by the rotation of the paper feed roller 9 when being interposed between the paper feed roller 9 and the paper feed pad 10. A fed paper sheet 3 is carried between the paper feed roller 9 and the pinch roller 12 to the resist roller 13. The resist roller 13 is composed of a pair of rollers opposed to each other, and carries the paper sheet 3 toward a transfer position of the image forming unit 5 (a nip position between a photoconductor drum 28 and a transfer roller 30, which will be explained later, for transferring a toner image on the photoconductor drum 28 to the paper sheet 3) after resist.

The image forming unit 5 comprises a scanner unit 17, the process cartridge 18, a fixing unit 19 and the like. The scanner unit 17 is provided at the upper portion in the body casing 2, and comprises a laser source (not illustrated in the figure), a polygon mirror 20 driven to rotate, an f9 lens 21, a reflecting mirror 22, a lens 23, another reflecting mirror 24 and the like. A laser beam based on image data, which is emitted from the laser source, is deflected by the polygon mirror 20 as shown in the chain line and passes the f6 lens 21, the optical path is folded by the reflecting mirror 22, the laser beam further passes the lens 23, and the optical path is further inflected downward by the reflecting mirror 24, so that the laser beam is irradiated onto the surface of the photoconductor drum 28, which will be explained later, of the process cartridge 18 by fast scan.

The process cartridge 18 is mounted detachably to the body casing 2 below the scanner unit 17. This process cartridge 18 comprises a drum cartridge 25 and a developing cartridge 26 which is mounted detachably to the drum cartridge 25 as a developing apparatus.

The drum cartridge 25 comprises: the developing cartridge 17 26 mounted at the front side; and the photoconductor drum 28, a scorotron charger 29, the transfer roller 30 and a cleaning brush 31 provided at the back side thereof, between a pair of side plates 27, which respectively extend in the anteroposterior direction and are arranged opposite to each other in a direction perpendicular to the anteroposterior direction (direction perpendicular to the paper surface of FIG. 1, which will be hereinafter referred to just as "width direction").

The photoconductor drum 28 comprises: a cylindrical drum body 32 having the surface layer formed of a positively-charged photosensitive layer made of polycarbonate or the like; and a drum shaft 33 made of metal, which extends along the longitudinal direction of the drum body 32 at the axis of this drum body 32. The drum shaft 33 is supported at the side plates 27 of the drum cartridge 25 so as not to be rotatable and the drum body 32 is supported so as to be rotatable with respect to this drum shaft 33, so that the photoconductor drum 28 is provided between the side plates 27 so as to be rotatable on the drum shaft 33.

The scorotron charger 29 is arranged opposite to the photoconductor drum 28 with a distance obliquely above the back side of the photoconductor drum 28 so as not to come in contact with the photoconductor drum 28. This scorotron charger 29 is a charger of scorotron type for positive charge which generates corona discharge from a charging wire such as tungsten, and is provided so as to positively charge the surface of the photoconductor drum 28 uniformly.

The transfer roller 30 is supported at the side plates 27 of the drum cartridge 25 so as to be freely rotatable, and is arranged so as to be opposed to and come in contact with the photoconductor drum 28 in the vertical direction and to form a nip between the photoconductor drum 28 and the transfer roller 30. This transfer roller 30 is constructed by coating a roller shaft 34 made of metal with a roller 35 made of conductive rubber material. For transfer, transfer bias is applied to the transfer roller 30. The cleaning brush 31 is arranged behind the photoconductor drum 28 with a point of the brush being in contact with the surface of the drum body 32 of the photoconductor drum 28.

Figure 2:
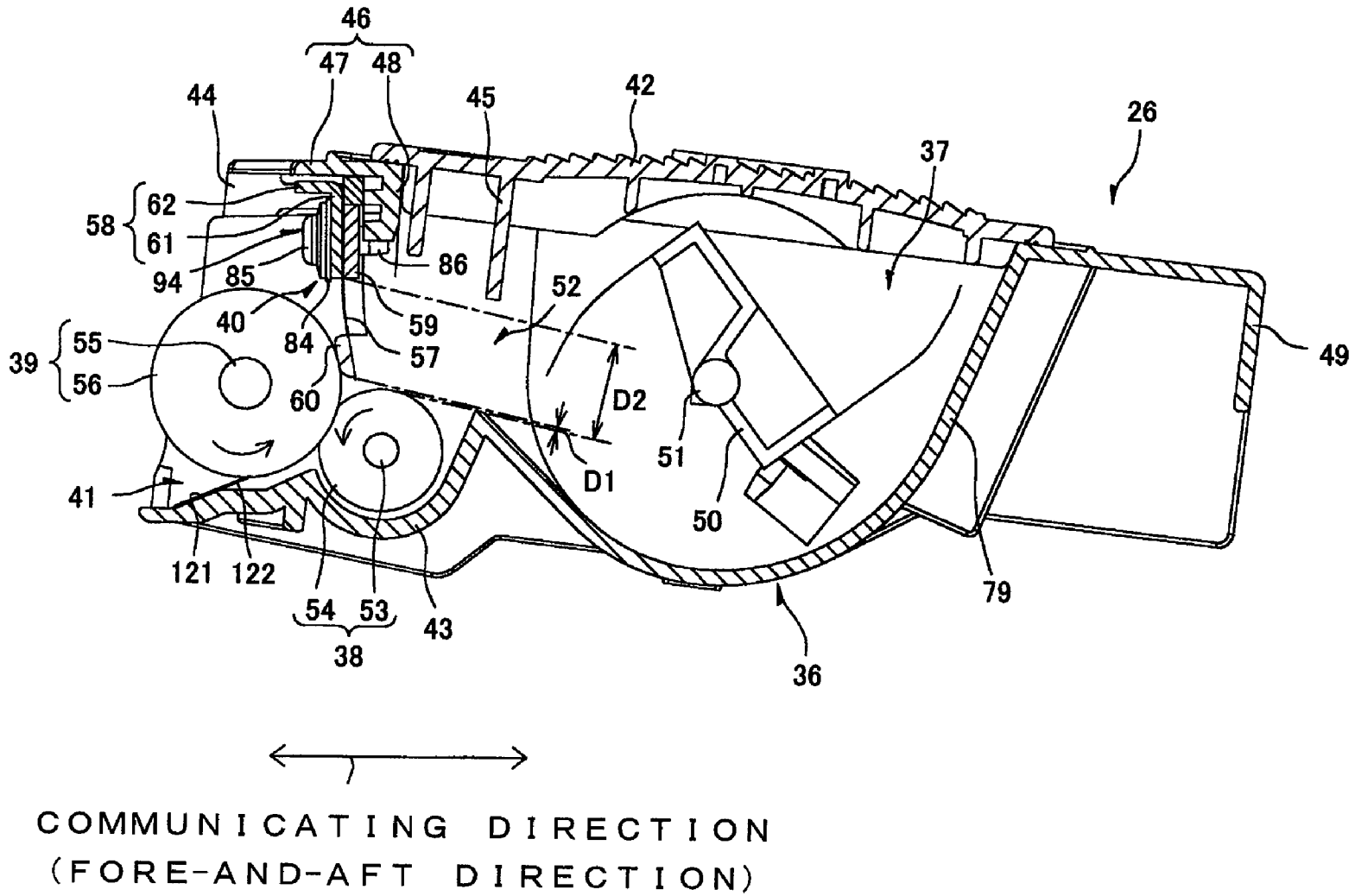
FIG. 2 is a sectional side view of a developing cartridge shown in FIG. 1.

The developing cartridge 26 comprises: a case 36; and a toner holding chamber 37, a feed roller 38, a developing roller 39 as a developer retainer, and a blade unit 40 in this case 36, as shown in FIG. 2.

Figure 3:
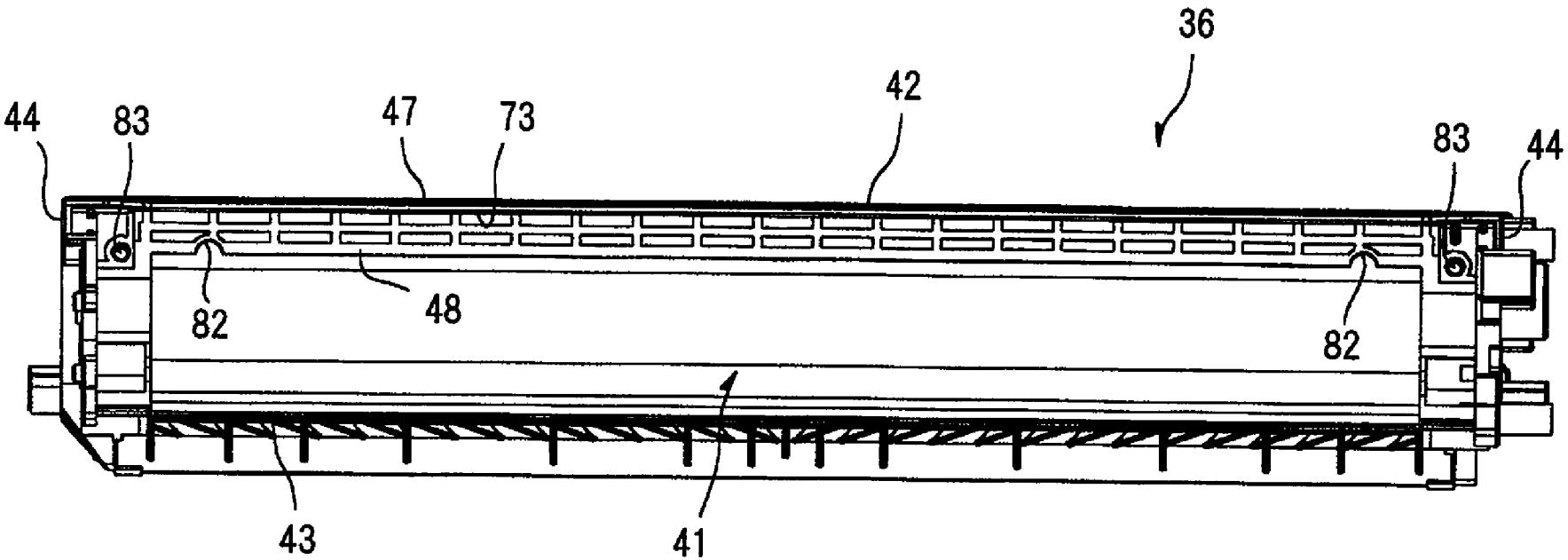
FIG. 3 is a rear view of a case of the developing cartridge shown in FIG. 2.
Figure 4:
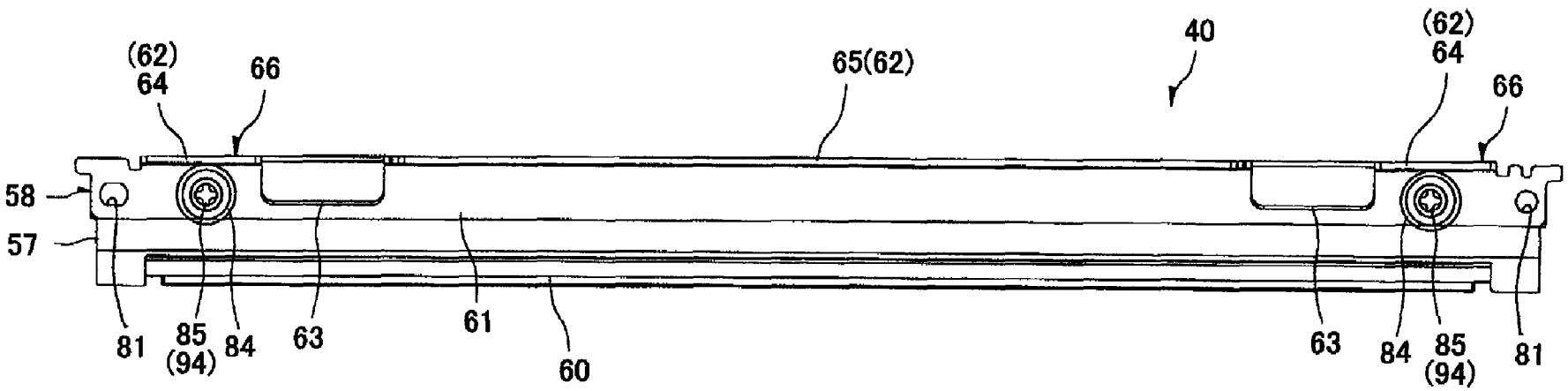
FIG. 4 is a rear view of a blade unit shown in FIG. 2.
Figure 5:
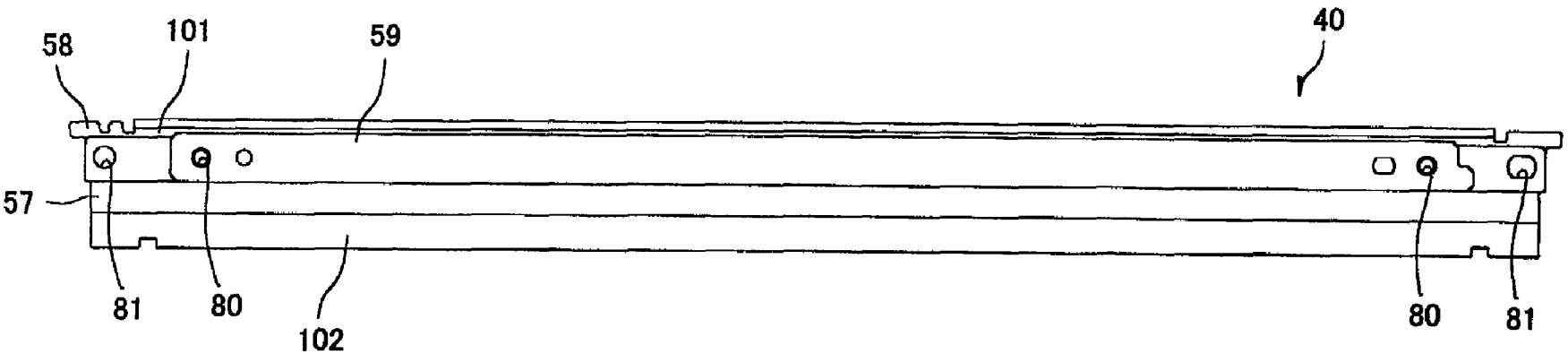
FIG. 5 is a front view of the blade unit shown in FIG. 2.
Figure 6:
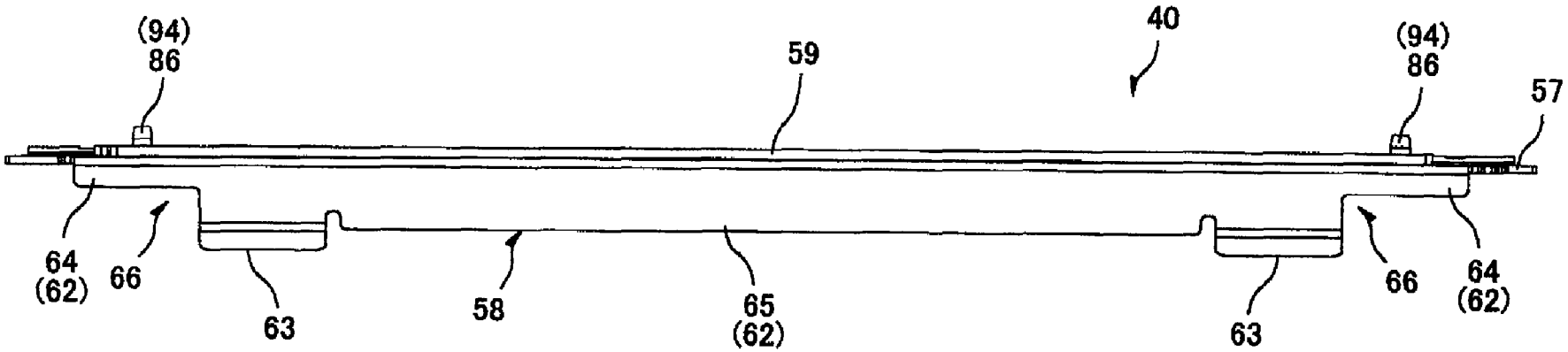
FIG. 6 is a plan view of the blade unit shown in FIG. 2.
Figure 7:
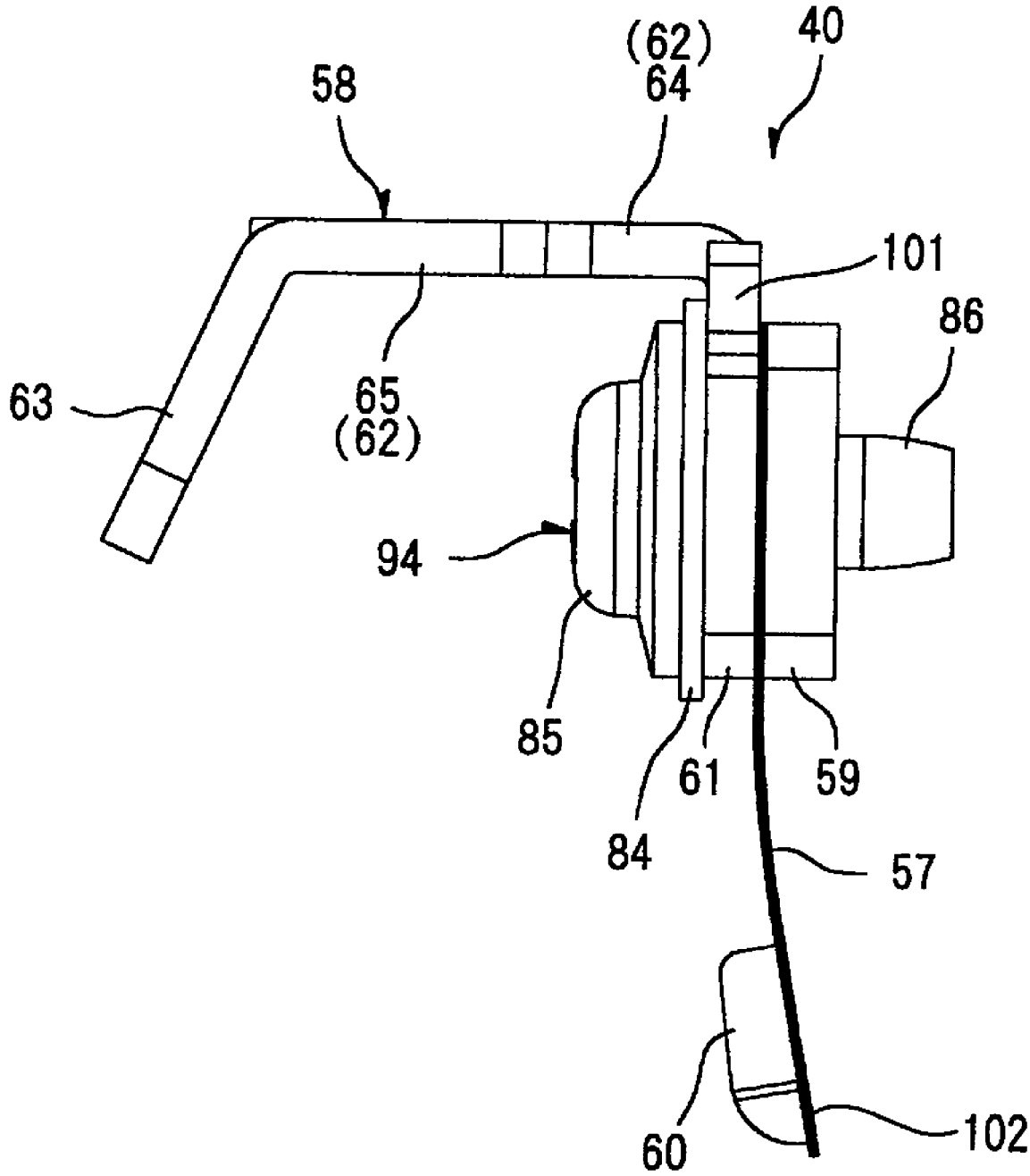
FIG. 7 is a side view of the blade unit shown in FIG. 2.

The case 36 is formed to have a box-like shape which has a slit-shaped opening 41 at the back end portion. In particular, as shown in FIGS. 2 and 3, the case 36 comprises: an upper wall 42 and a lower wall 43 which are opposed to each other in the vertical direction; a pair of sidewalls 44 provided so as to close the space between these upper wall 42 and lower wall 43 from both width-direction sides; and a front wall 79 provided so as to close the space between the upper wall 42 and the lower wall 43 from the front side.

The upper wall 42 comprises a partition plate 45 which extends from a middle portion in the anteroposterior direction nearer to the back side toward the lower wall 43 as shown in FIG. 2. This partition plate 45 separates the internal space of the case 36 and the internal space at the front side is blocked out as the toner holding chamber 37. Moreover, a blade attachment member 46 for attaching the blade unit 40 is provided at the back end portion of the upper wall 42, and the slit-shaped opening 41 which extends in the width direction is blocked out by this blade attachment member 46, the lower wall 43 and the pair of sidewalls 44. A direction in which the toner holding chamber 37 and the opening 41 communicate is referred to as a communication direction. That is, in the present example, the communication direction accords with the anteroposterior direction.

The blade attachment member 46 is formed to have an L-shaped side section. In particular, the blade attachment member 46 comprises: a plate-like upper attachment portion 47, which is opposed to the lower wall 43, extends in the width direction and has a width in the anteroposterior direction; and a front attachment portion 48, which is curved downward from the front end portion of the upper attachment portion 47, extends in the width direction, has a width in the vertical direction and is provided with a lattice like recess seen from the backside.

This blade attachment member 46 may be formed separately from the upper wall 42 and fastened to the upper wall 42, or may be formed integrally with the upper wall 42. When the blade attachment member 46 is formed integrally with the upper wall 42, it is possible to reduce the number of components of this laser printer 1 and to simplify the structure.

At the front attachment portion 48, recesses 82 for preventing collision with assembly screws 94, which will be explained later, are formed by notching the lower edge of the longitudinal end portions in a semi-circular shape. Moreover, at the front attachment portion 48, tapped holes 83 for screwing attachment screws (not illustrated in the figure) for attaching the blade unit 40 to the blade attachment member 46 (front attachment portion 48) are formed at positions with a distance from the respective recesses 82 outward in the longitudinal direction.

The front end portion of the lower wall 43 extends obliquely upward from the front side and is connected in succession with the front wall 79. Moreover, a film arrangement portion 121 which extends along the axial direction of the developing roller 39 is formed at the back upper face of the lower wall 43. This film arrangement portion 121 is provided with a lower film 122 which is made of polyethylene terephthalate and frictioned uniformly with the outer surface of a roller 56 of the developing roller 39 along the axial direction thereof. Since the lower film 122 is frictioned uniformly with the outer surface of the roller 56 of the developing roller 39 along the axial direction thereof above the lower wall 43, it is possible to prevent toner leakage from between the lower wall 43 and the developing roller 39. Furthermore, the front wall 79 is provided with a gripper 49, which extends forward from the connected portion with the upper wall 42 and is further folded downward, to be gripped in order to attach and detach the developing cartridge 26 to and from the drum cartridge 25.

In the toner holding chamber 37, toner of a positively charged non-magnetic first component is held as developer. Used as the toner is polymer toner obtained by copolymerizing polymerizable monomer, e.g. styrene monomer such as styrene or acrylic monomer such as acrylic acid, alkyl (C1-C4) acrylate or alkyl (C1-C4) methacrylate, by a known polymerization method such as suspension polymerization. Such polymer toner is of spherical shape and has extremely favorable fluidity, and it is possible to achieve high-quality image formation. It should be noted that wax or coloring agent such as carbon black is compounded in such toner and addition agent such as silica is added in order to enhance the fluidity. The particle diameter thereof is approximately 6-10 μm.

Moreover, an agitator 50 for stirring toner in the toner holding chamber 37 is provided in the toner holding chamber 37. The agitator 50 is supported at a rotating shaft 51, which extends in the width direction, at a center portion of the toner holding chamber 37, and toner in the toner holding chamber 37 is stirred and discharged backward from a communication port 52 between the partition plate 45 and the lower wall 43 when the agitator 50 is rotated on the rotating shaft 51 as the supporting point.

The feed roller 38 is arranged obliquely below the back side 22 of the communication port 52 and is supported between the pair of sidewalls 44 of the case 36 so as to be rotatable. This feed roller 38 is constructed by coating a roller shaft 53 made of metal with a roller 54 made of conductive foamed material.

The developing roller 39 is arranged along the width direction at the opening 41 at the back side of the feed roller 38 and is supported between the pair of sidewalls 44 of the case 36 so as to be rotatable. Moreover, the developing roller 39 comes in contact with and is opposed to the photoconductor drum 28 in the anteroposterior direction with a portion of the surface thereof being arranged so as to be projected and exposed backward from the opening 41 of the case 36 and with the developing cartridge 26 being mounted to the drum cartridge 25. This developing roller 39 is constructed by coating a roller shaft 55 made of metal with the roller 56 made of conductive rubber material. The roller 56 of the developing roller 39 is provided with the surface of a roller layer made of conductive urethane rubber or silicone rubber including carbon fine particles and the like, which is coated with a coat layer made of urethane rubber or silicone rubber including fluorine. Moreover, the roller 56 of the developing roller 39 is arranged so as to come in contact with the roller 54 of the feed roller 38 so as to be compressed by each other.

As shown in FIG. 4, 5, 6 or 7, the blade unit 40 comprises: a leaf spring member 57 as a blade; a bend preventing member 58 and a reinforcing plate 59 for supporting this leaf spring member 57; the assembly screws 94 for fastening them to each other; and seal washers 84. As described later, this blade unit 40 is attached to the blade attachment member 46 so that the reinforcing plate 59 comes in contact with and is opposed to the front attachment portion 48 with the leaf spring member 57 being interposed between the bend preventing member 58 and the reinforcing plate 59. It should be noted that the blade is composed of the leaf spring member 57 and the bend preventing member 58 in this example.

The leaf spring member 57 is made of thin leaf spring material of metal and is formed to have a rectangular shape having substantially the same width as the axial width of the roller 56 of the developing roller 39. The upper end portion of this leaf spring member 57 is interposed between the bend preventing member 58 and the reinforcing plate 59 and arranged so as to extend in the axial direction (longitudinal direction) of the developing roller 39 in a state where the blade unit 40 is attached to the blade attachment member 46. Moreover, a pressing member 60 having a rectangular section made of insulating silicone rubber is provided at a lower end portion 102, which functions as a second end portion, of the leaf spring member 57 so as to extend in the longitudinal direction of the leaf spring member 57.

The bend preventing member 58 has an L-shaped side section, extends along the longitudinal direction of the leaf spring member 57 and is arranged opposite to the upper end portion of the surface of the leaf spring member 57. This bend preventing member 58 integrally comprises: a rectangular plate-like contact portion 61 to come in contact with the surface of the leaf spring member 57; an extended portion 62 which extends backward from an upper edge 101, which functions as a first end portion, of the contact portion 61 in a state where the blade unit 40 is attached to the blade attachment member 46; and two grippers 63 extending downward from the back end portion of the extended portion 62. Thus, the bend preventing member 58 has high rigidity, supports the leaf spring member 57 and prevents flexion such as deflection or undulation of the leaf spring member 57.

The extended portion 62 comprises: end extended portions 64 having a first width, which extend from the longitudinal end portions of the upper edge of the contact portion 61; and a central extended portion 65 having a second width larger than the first width, which extends from the longitudinal center portion of the upper edge of the contact portion 61. In other words, the extended portion 62 extends backward from the longitudinal entire area of the upper edge of the contact portion 61 and has notch portions 66 at the longitudinal end portions thereof. The two grippers 63 respectively extend obliquely backward and downward with respect to the central extended portion 65 from the longitudinal end portions of the central extended portion 65 and are formed to have a rectangular shape seen from the backside.

The reinforcing plate 59 is made of an elongated rectangular metal plate, extends along the back surface in the longitudinal direction of the leaf spring member 57 and is arranged at a position which is opposed to the contact portion 61 of the bend preventing member 58 with the leaf spring member 57 being interposed there between. Moreover, the reinforcing plate 59 is formed to have a width slightly smaller than the width (width in the vertical direction) of the contact portion 61 of the bend preventing member 58. This reinforcing plate 59 supports the upper end portion of the leaf spring member 57 interposed between the bend preventing member 58 and the reinforcing plate 59, so as to further reinforce the leaf spring member 57.

Each assembly screw 94 integrally comprises a screw head 85 and a screw shaft 86 which extends from this screw head 85. Each assembly screw 94 fastens the bend preventing member 58 and reinforcing plate 59 and the leaf spring member 57 interposed there between to each other, by inserting each screw shaft 86 into an insertion hole (not illustrated in the figure) formed at each of the longitudinal end portions of the bend preventing member 58 and the reinforcing plate 59 from the bend preventing member 58 side with the upper end portion of the leaf spring member 57 being interposed between the bend preventing member 58 and the reinforcing plate 59, and by screwing each screw shaft 86 into each thread groove hole 80 formed at each of the end portions of the reinforcing plate 59. It should be noted that it is possible to insert the assembly screws 94 even from the bend preventing member 58 side easily since the notch portions 66 are formed at the longitudinal end portions of the extended portion 62 of the bend preventing member 58.

It should be noted that the lower end face of the contact portion 61 and the lower end face of the reinforcing plate 59 of the blade unit 40 assembled as described above are positioned to have substantially the same face in the vertical direction. Each seal washer 84 is made of rubber material and is formed to have an annular plate-like shape to which the screw shaft 86 of the assembly screw 94 can be inserted. In assembling with the assembly screws 94 described above, each seal washer 84 is interposed between the screw head 85 of the assembly screw 94 and the contact portion 61 of the bend preventing member 58 by inserting the screw shaft 86 of the assembly screw 94 into the seal washer 84 and then inserting the screw shaft 86 into the bend preventing member 58, the leaf spring member 57 and the reinforcing plate 59.

As shown in FIG. 2, the blade unit 40 is attached to the blade attachment member 46 so that the extended portion 62 of the bend preventing member 58 is opposed to the upper attachment portion 47 with a distance and the reinforcing plate 59 comes in contact with and is opposed to the front attachment portion 48. In this attachment, the blade unit 40 can be attached to the blade attachment member 46 easily since the blade unit 40 can be positioned with respect to the blade attachment member 46 by gripping the grippers 63 from the notch portions 66. Moreover, in attachment of the blade unit 40, the blade unit 40 is fastened to the blade attachment member 46 by inserting the attachment screws (not illustrated in the figure) into attachment holes 81 (see FIGS. 4 and 5) running through the thickness direction thereof at the longitudinal end portions (end portions lateral to the longitudinal end portions where each screw 94 is screwed) of the contact portion 61 of the bend preventing member 58, the leaf spring member 57 and the reinforcing plate 59 and screwing the attachment screws into the tapped holes 83 of the blade attachment member 46.

It should be noted that one attachment hole 81 is formed to be a circular hole corresponding to the major diameter of the screw shaft of the attachment screw and the other attachment hole 81 is formed to be a long hole elongated in the longitudinal direction of the contact portion 61, the leaf spring member 57 and therein forcing plate 59. By forming one attachment hole 81 to be a long hole, it is possible to allow a tolerance of the formation position of the attachment holes 81 in the longitudinal direction and to attach the blade unit 40 to the blade attachment member 46 easily. Moreover, in attachment of the blade unit 40 to the blade attachment member 46, since the point portion of the screw shaft 86 of the assembly screw 94 projected from the reinforcing plate 59 enters the recess 82 of the front attachment portion 48, it is possible to prevent collision between the point portion of the screw shaft 86 and the front attachment portion 48. It is therefore possible to make the reinforcing plate 59 in contact with the front attachment portion 48 without a clearance.

In a state where the blade unit 40 is attached to the blade attachment member 46, the lower end portion of the leaf spring member 57 is opposed to the roller 56 of the developing roller 39 from the front side and the pressing member 60 is welded to the roller 56 by pressure welding by elastic force of the leaf spring member 57. Toner discharged from the communication port 52 to the back side internal space of the case 36 by the rotation of the agitator 50 is supplied onto the roller 56 of the developing roller 39 by the rotation of the feed roller 38 and, at this time, is positively charged by frictional electrification between the roller 54 of the feed roller 38 and the roller 56 of the developing roller 39. Toner supplied onto the roller 56 of the developing roller 39 enters the space between the pressing member 60 of the blade unit 40 and the roller 56 of the developing roller 39 with the rotation of the developing roller 39, is further sufficiently discharged by frictional electrification here, forms a thin layer having a constant thickness and is retained on the roller 56 of the developing roller 39.

It should be noted that, regarding this developing cartridge 26, the vertical distance D1 between the lower edge of the leaf spring member 57 and the uppermost position of the roller 54 of the feed roller 38 is smaller than or equal to 2 mm, and having such a distance D1 makes it possible to carry toner charged between the roller 54 of the feed roller 38 and the roller 56 of the developing roller 39 to the position of the pressing member 60 immediately and to eliminate the need for high charge of toner. Moreover, the vertical distance D2 between the lower edge of the reinforcing plate 59 and the uppermost position of the roller 54 of the feed roller 38 is larger than or equal to 15 mm, and having such a distance D2 makes it possible to feed toner in the toner holding chamber 37 to the developing roller 39 side smoothly.

On the other hand, as shown in FIG. 1, the surface of the photoconductor drum 28 is positively charged uniformly by the scorotron charger 29 and then exposed to light by rapid scanning of a laser beam from the scanner unit 17, so that an electrostatic latent image based on image data is formed. Next, by the rotation of the developing roller 39, toner which is retained on the developing roller 39 and is positively charged is supplied to an electrostatic latent image formed on the surface of the photoconductor drum 28, i.e. an exposure portion of the surface of the photoconductor drum 28 positively charged uniformly which is exposed to light by a laser beam and has lowered potential, when coming in contact with and being opposed to the photoconductor drum 28 and is retained selectively, so that image visualization is achieved and therefore a toner image is formed by reversal development.

Then, the photoconductor drum 28 and the transfer roller 30 are driven to rotate so as to convey a paper sheet 3 interposed there between and the paper sheet 3 is conveyed between the photoconductor drum 28 and the transfer roller 30, so that a toner image retained on the surface of the photoconductor drum 28 is transferred onto the paper sheet 3. It should be noted that paper powder attached to the surface of the photoconductor drum 28 by contact with the paper sheet 3 is removed by a brush of the conductive brush 31 after transferring, when the surface of the photoconductor drum 28 is opposed to the brush with the rotation of the photoconductor drum 28.

The fixing unit 19 is provided at the back side of the process cartridge 18, and comprises a fixing frame 67, and a heating roller 68 and a pressing roller 69 in this fixing frame 67. The heating roller 68 comprises a metal raw tube and a halogen lump for heating in the metal raw rube and is driven to rotate by input of power from a motor (not illustrated in the figure). The pressing roller 69 is arranged opposite below the heating roller 68 so as to press the heating roller 68. This pressing roller 69 is constructed by coating a roller shaft made of metal with a roller made of rubber material, and is driven to follow the rotation drive of the heating roller 68.

Toner transferred onto the paper sheet 3 undergoes heat fusing at the fixing unit 19 when the paper sheet 3 is conveyed between the heating roller 68 and the pressing roller 69. The paper sheet 3 to which toner is fixed is conveyed to a delivery path 70 which extends in the vertical direction toward the upper face of the body casing 2. The paper sheet 3 conveyed to the delivery path 70 is delivered onto an output tray 72 formed on the upper face of the body casing 2, by a delivery roller 71 provided at the upper end thereof. (First Embodiment: First Example)

Figure 8:
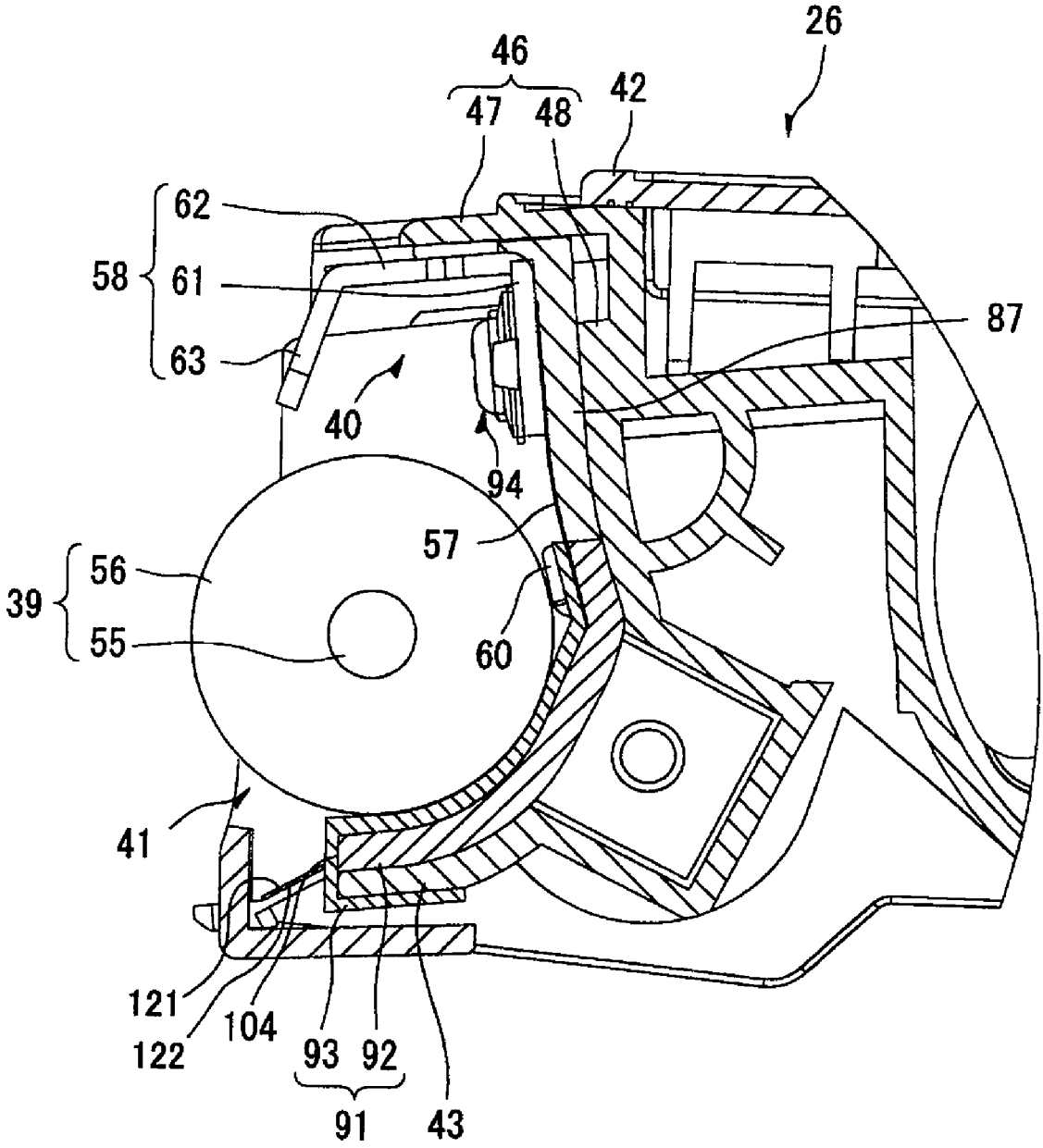
FIG. 8 is a sectional side view showing the structure around a blade unit of a developing cartridge (First Embodiment: First Example)

At this developing cartridge 26, a blade back seal 87 which functions as a sealing member for sealing the space between the leaf spring member 57 and bend preventing member 58 and the front attachment portion 48 that functions as a wall portion is interposed between the leaf spring member 57 and bend preventing member 58 of the blade unit 40 and the front attachment portion 48 of the blade attachment member 46, as shown in FIG. 8.

Figure 9:
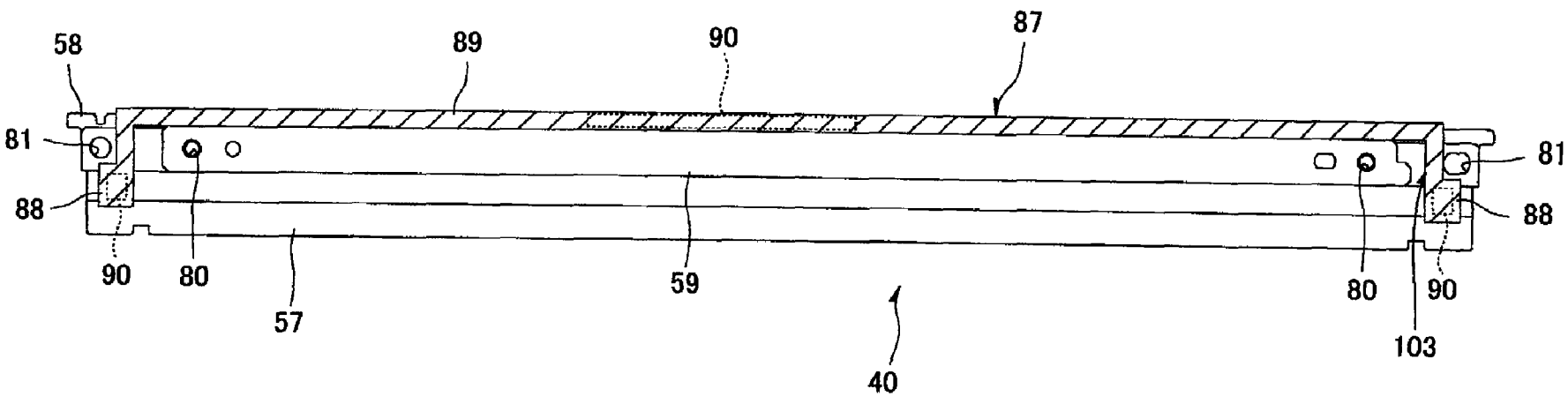
FIG. 9 is a rear view showing the structure of a blade back seal and the blade unit shown in FIG. 8.

The blade back seal 87 is made of sponge material such as urethane foam and, as shown in FIG. 9, integrally comprises: two side portions 88, which are arranged at the back surface of the contact portion 61 of the bend preventing member 58 and the leaf spring member 57 so as not to be overlapped with the reinforcing plate 59 that functions as a supporting member and extends at the longitudinal end portions of the leaf spring member 57 along the vertical direction; and a seal connecting portion 89, which extends at the longitudinal center portion of the leaf spring member 57 along the width direction, for connecting the side portions 88. In particular, at the back surface of the contact portion 61 of the bend preventing member 58 and the leaf spring member 57, an arrangement margin 103 for arranging the blade back seal 87 is provided around the reinforcing plate 59, and the blade back seal 87 is arranged so that the side portions 88 respectively come in contact with the back surface of the leaf spring member 57 at the longitudinal sides of the reinforcing plate 59 at the arrangement margin 103 and the connecting portion 89 comes in contact with the back surface of the contact portion 61 of the bend preventing member 58 at the upper side of the reinforcing plate 59.

Moreover, in a state before the blade unit 40 is attached to the blade attachment member 46, the blade back seal 87 has a thickness larger than the thickness of the reinforcing plate 59 in the anteroposterior direction (direction perpendicular to the back surface of the leaf spring member 57). This blade back seal 87 is applied to the back surface of the leaf spring member 57 and the bend preventing member 58 by partially applying the blade back seal 87 to two-sided tape 90, which includes polyethylene terephthalate as the medium and is arranged at the arrangement margin 103 at the longitudinal center portion of the connecting portion 89 and the lower end portion of the side portions 88.

Figure 10:
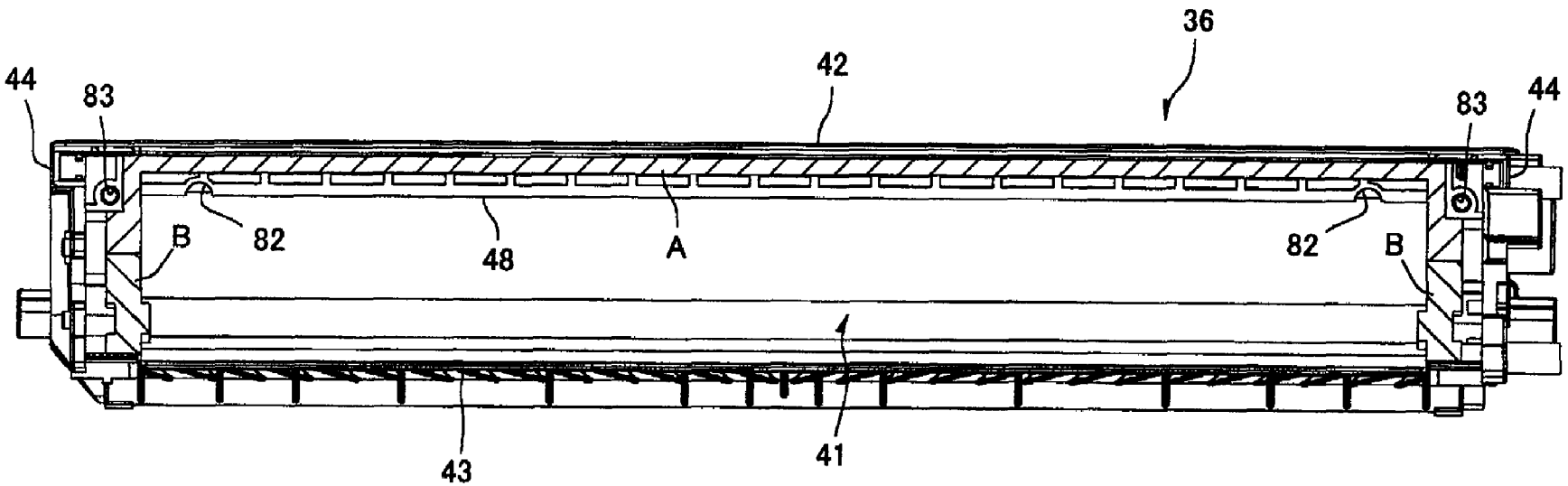
FIG. 10 is a rear view showing the application positions of the blade back seal and a side seal shown in FIG. 8.

In a state where the blade unit 40 is attached to the blade attachment member 46, the blade back seal 87 comes in contact with an area A, which is shown by hutching in FIG. 10, at the case 36 side. That is, the side portions 88 come in contact with the upper portion of the back end face of the sidewalls 44 and the longitudinal end portions of the front attachment portion 48 and the connecting portion 89 comes in contact with the upper end portion of the front attachment portion 48. The side portions 88 are compressed inward in the opposed direction of the front attachment portion 48 and the leaf spring member 57 between the front attachment portion 48 and the leaf spring member 57 and elastically press the front attachment portion 48 and the leaf spring member 57 respectively.

Moreover, between the front attachment portion 48 and the bend preventing member 58, the connecting portion 89 is compressed inward in the opposed direction of the front attachment portion 48 and the bend preventing member 58 and elastically presses the front attachment portion 48 and the bend preventing member 58 respectively. Thus, it is possible to reliably seal the space between the end portions of the front attachment portion 48 and the leaf spring member 57 by the respective side portions 88 of the blade back seal 87. Moreover, it is possible to reliably seal the space between the front attachment portion 48 and the bend preventing member 58 over the longitudinal entire area by the connecting portion 89 of the blade back seal 87. It is therefore possible to prevent toner which enters the back surface of the leaf spring member 57 from getting over the upper end portion of the leaf spring member 57 from the back surface and running round to above the bend preventing member 58 and to reliably preventing leakage from the blade unit 40 and the upper attachment portion 47 of the blade attachment member 46.

Moreover, since the blade back seal 87 is arranged so as not to be overlapped with the reinforcing plate 59 and a clearance is not generated between the back surface of the contact portion 61 of the bend preventing member 58 and the leaf spring member 57, it is possible to reliably seal the space between the front attachment portion 48 and the blade unit 40. Moreover, since the blade back seal 87 is interposed between the front attachment portion 48 and the leaf spring member 57 and bend preventing member 58 in a compressed manner, it is possible to achieve high sealing performance and to prevent leakage of toner from between the front attachment portion 48 and the blade unit 40 more reliably.

Furthermore, since each seal washer 84 is interposed between the screw head 85 of each assembly screw 94 which functions as a fastening member and the contact portion 61 of the bend preventing member 58, it is possible to seal the space between the screw head 85 of the assembly screw 94 and the contact portion 61 of the bend preventing member 58 by this seal washer 84. It is therefore possible to prevent toner which enters the space between the screw shaft 86 and the thread groove hole 80 from leaking from between the screw head 85 and the contact portion 61. It is therefore possible to prevent leakage of toner more reliably.

Moreover, since the side portions 88 and the connecting portion 89 are formed integrally, it is possible to arrange the blade back seal 87 at the back surface of the bend preventing member 58 and the leaf spring member 57 accurately and simply. It is therefore possible to reduce the trouble of arranging the blade back seal 87.

Furthermore, since the arrangement margin 103 for arranging the blade back seal 87 is provided at the back surface of the bend preventing member 58 and the leaf spring member 57, it is possible to arrange the blade back seal 87 more simply so as not to be overlapped with the reinforcing plate 59. It is therefore possible to further reduce the trouble of arranging the blade back seal 87.

Moreover, since the two-sided tape 90 for fastening the blade back seal 87 to the leaf spring member 57 is applied partially to the blade back seal 87, it is possible to reduce the trouble of fastening the blade back seal 87 to the leaf spring member 57 and the bend preventing member 58. Furthermore, since the two-sided tape 90 includes polyethylene terephthalate as the medium and has high nerve, it is possible to prevent deformation (elongation) of the blade back seal 87 even when relatively large force is applied to the blade back seal 87 during applying one face of the two-sided tape 90 to the blade back seal 87 and then applying the other face of the two-sided tape 90 to the leaf spring member 57 and the bend preventing member 58. It is therefore possible to apply the blade back seal 87 accurately to the arrangement margin 103 provided at the bend preventing member 58 and the leaf spring member 57.

Moreover, since this laser printer 1 comprises the developing cartridge 26 capable of reducing the trouble of arranging the blade back seal 87 and reliably preventing leakage of toner, it is possible to reduce the trouble of manufacturing the process cartridge 18 and, furthermore, it is possible to reduce the trouble of manufacturing the laser printer 1. Moreover, at this developing cartridge 26, as shown in FIG. 10, side seals 91 which function as a side sealing member for preventing leakage of toner from the axial end portions of the developing roller 39 are arranged at the lower portion (area B shown by hutching) of the back end face of the respective sidewalls 44 at the longitudinal end portions of the opening 41 of the case 36.

As shown in FIG. 8, the side seals 91 are provided at the axial end portions of the roller 56 of the developing roller 39 so as to be frictioned with the surface of the roller 56. Each side seal 91 comprises a sponge sealing member 92 and a felt sealing member 93 which is laminated on the sponge sealing member 92.

The sponge sealing member 92 is made of sponge material such as urethane foam, or in particular sponge material (trade name: Poron, manufactured by Rogers Inoac Corporation) having relatively high rigidity among sponge materials, and formed to have a rectangular shaped having a certain level of thickness so that a predetermined pressing force is developed when the developing roller 39 is mounted and the sponge sealing member 92 is compressed. This sponge sealing member 92 extends along the rotative direction of the developing roller 39 on the back end face of the sidewall 44 of the case 36 and is arranged so that the end face at the downstream side in the rotative direction thereof is connected with the lower end face of the side portion 88 of the blade back seal 87 and the end face at the upstream side in the rotative direction has the same face as a lower end face 104 of the back end face of the sidewall 44.

The felt sealing member 93 is made of felt constituted of polyester fiber and is formed to have the same width as the width of the sponge sealing member 92 in the width direction. This felt sealing member 93 is arranged so that the end portion at the down stream side in the rotative direction of the developing roller 39 extends is arranged astride the lower end portion of the leaf spring member 57 and the sponge sealing member 92, extends along the sponge sealing member 92 and runs round from the back end face of the sidewall 44 to the lower face thereof. A face of the felt sealing member 93 opposed to the roller 56 of the developing roller 39 is a friction face to be frictioned with the roller 56.

Since the side seal 91 are provided as described above, it is possible to prevent leakage of toner from the axial end portions of the developing roller 39. Moreover, since the friction face of the side seals 91 to be frictioned with the roller 56 of the developing roller 39 is made of felt, it is possible to reduce the friction resistance between the side seals 91 and the roller 56 of the developing roller 39 and to reliably prevent leakage of toner from the axial end portions of the developing roller 39.

It should be noted that, although the blade back seal 87 is applied to the leaf spring member 57 by the two-sided tape 90 and the blade unit 40 having the blade back seal 87 is applied to the blade attachment member 46 in this example, the blade unit 40 may be attached to the blade attachment member 46 after the two-sided tape 90 is applied to the front attachment portion 48 of the blade attachment member 46 and the blade back seal 87 is applied partially to the two-sided tape 90. (First Embodiment: Second Example)

Figure 11:
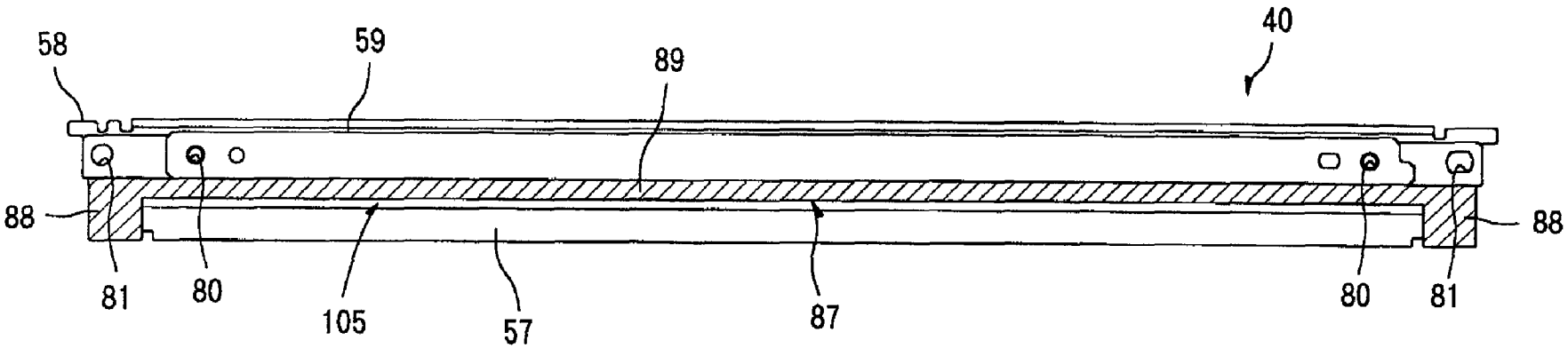
FIG. 11 is a front view of a blade unit of a developing cartridge (First Embodiment: Second Example)

FIG. 11 is a front view showing another example of the blade unit 40. It should be noted that like codes are used in FIG. 11 to refer to portions corresponding to the above portions and explanation thereof will be omitted.

In the blade unit 40 shown in FIG. 11, the entire area at the lower end portion side of the leaf spring member 57 with respect to the reinforcing plate 59 is set as an arrangement margin 105 at the back surface of the leaf spring member 57, and the blade back seal 87 is arranged at this arrangement margin 105. In particular, at the arrangement margin 105, the side portions 88 of the blade back seal 87 are arranged respectively at the longitudinal sides of the leaf spring member 57 and the connecting portion 89 of the blade back seal 87 is arranged along the lower edge of the reinforcing plate 59.

Figure 12:
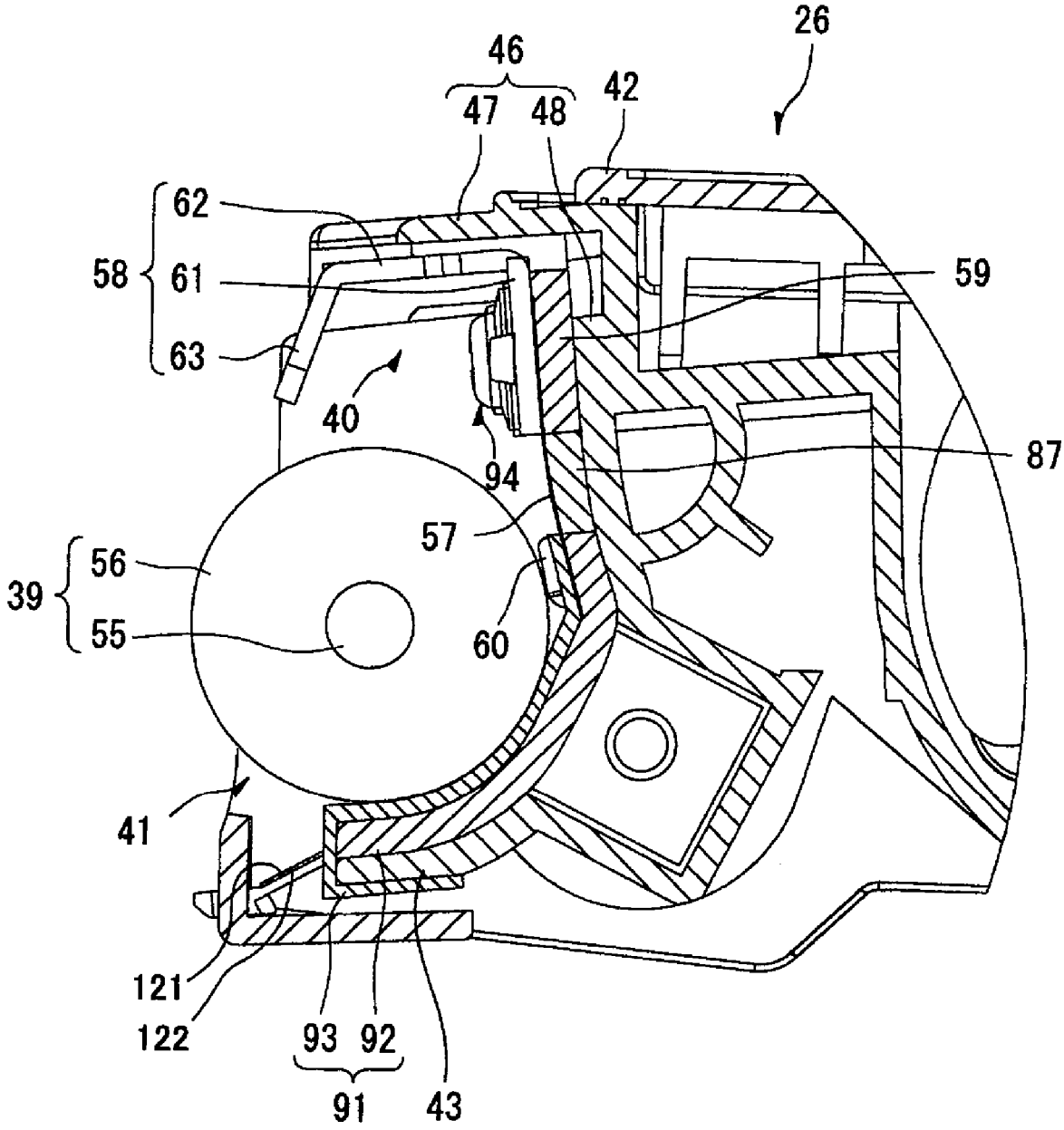
FIG. 12 is a sectional side view of the developing cartridge (First Embodiment: Second Example)

As shown in FIG. 12, in a state where the blade unit 40 is attached to the blade attachment member 46, the reinforcing plate 59 comes in contact with the front attachment portion 48 of the blade attachment member 46, so that the blade back seal 87 is compressed inward in the opposed direction of the front attachment portion 48 and the leaf spring member 57 between the front attachment portion 48 and the leaf spring member 57 and elastically presses the front attachment portion 48 and the leaf spring member 57 respectively.

Figure 13:
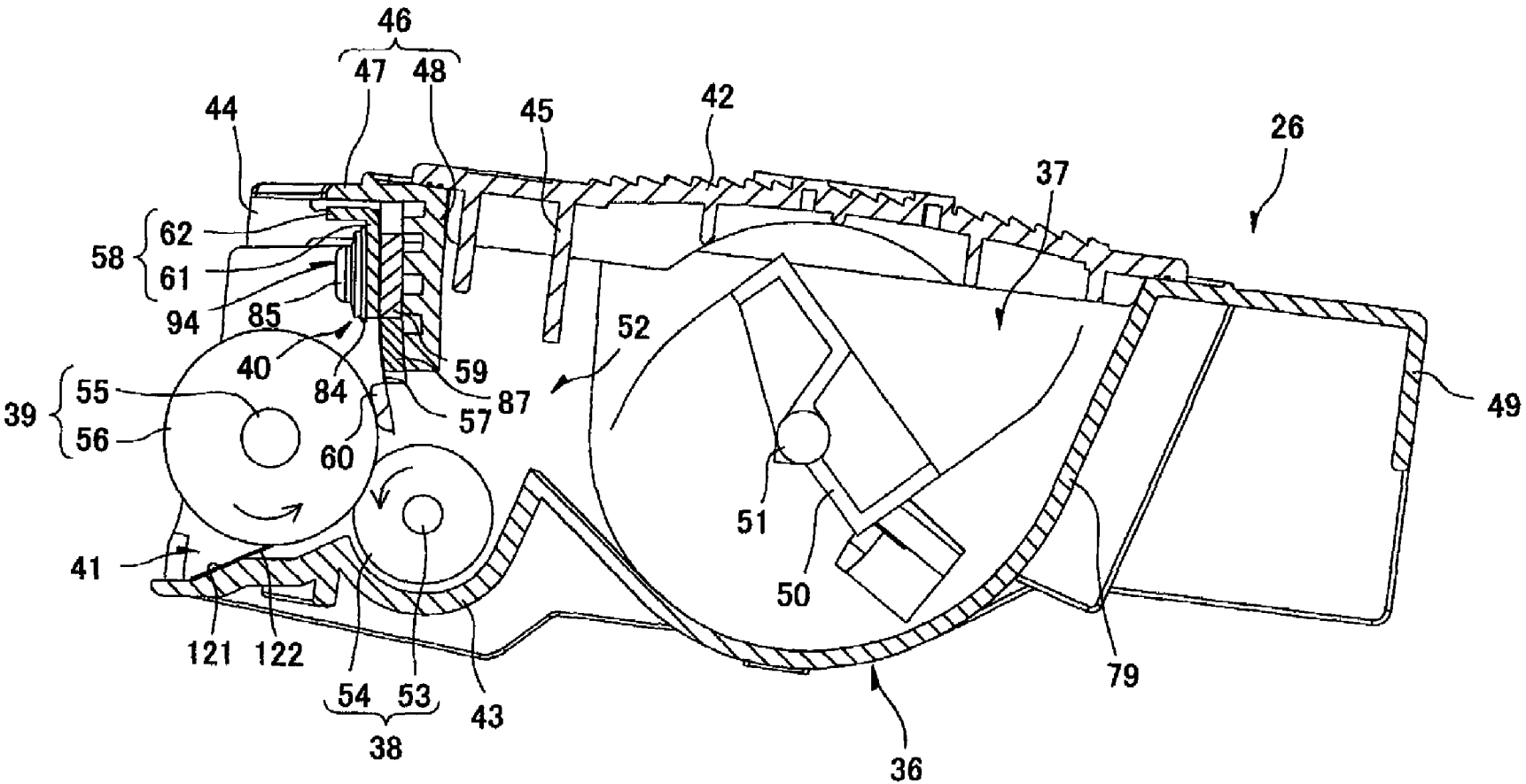
FIG. 13 is a center sectional side view of a case shown in FIG. 12.

It should be noted that the dimension of the front attachment portion 48 in the vertical direction needs to be increased at the longitudinal center portion of the opening 41 as shown in FIG. 13, when the blade back seal 87 is constructed as described above. This is for holding the connecting portion of the blade back seal 87 to the front attachment portion 48 and the leaf spring member 57 more reliably. Thus, it is possible to reliably seal the space between the end portions of the front attachment portion 48 and the leaf spring member 57 by the respective side portions 88 of the blade back seal 87. Moreover, it is possible to reliably seal the space between the front attachment portion 48 and the leaf spring member 57 over the longitudinal entire area by the connecting portion 89 of the blade back seal 87. It is therefore also possible to prevent toner which enters the back surface of the leaf spring member 57 from running round from the back surface to the upper end portion of the leaf spring member 57 and to reliably prevent leakage from between the leaf spring member 57 and the upper attachment portion 47 of the blade attachment member 46 with the structure of this example. (First Embodiment: Third Example)

Figure 14:
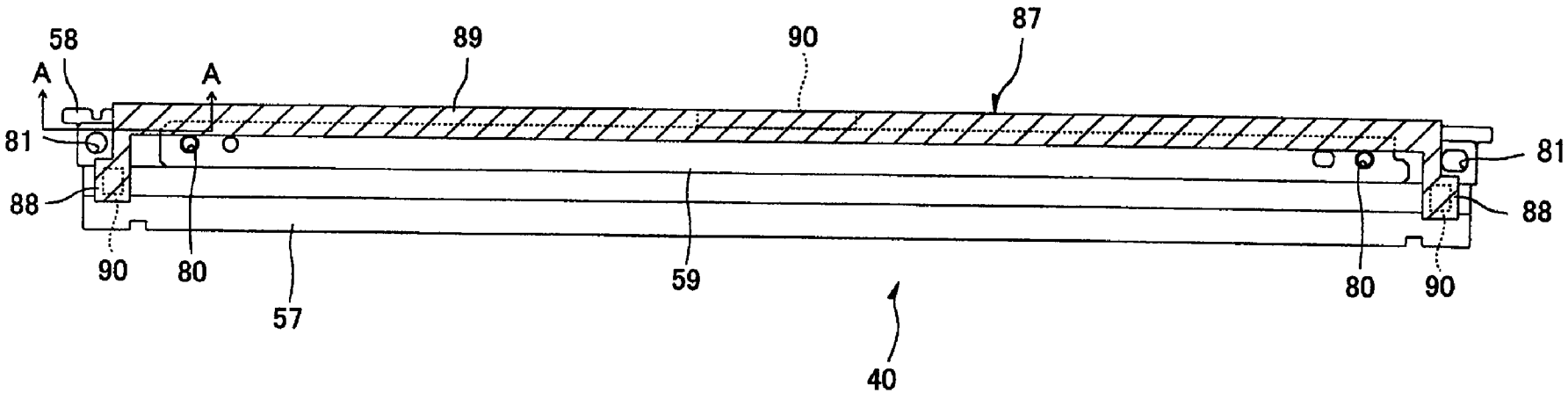
FIG. 14 is a front view of a blade unit of a developing cartridge (First Embodiment: Third Example)

FIG. 14 is a front view showing yet another example of the blade unit 40. It should be noted that like codes are used in FIG. 14 to refer to portions corresponding to the above portions and explanation thereof will be omitted.

In the blade unit 40 shown in FIG. 14, the connecting portion 89 of the blade back seal 87 is arranged on the reinforcing plate 59. That is, the connecting portion 89 is formed to have a slightly large width in the vertical direction and a portion thereof is arranged to be overlapped with the reinforcing plate 59. With such a structure, it is possible to keep the strength of the connecting portion 89 and to prevent deformation (elongation) of the connecting portion 89 when the blade back seal 87 is applied.

Figure 15:
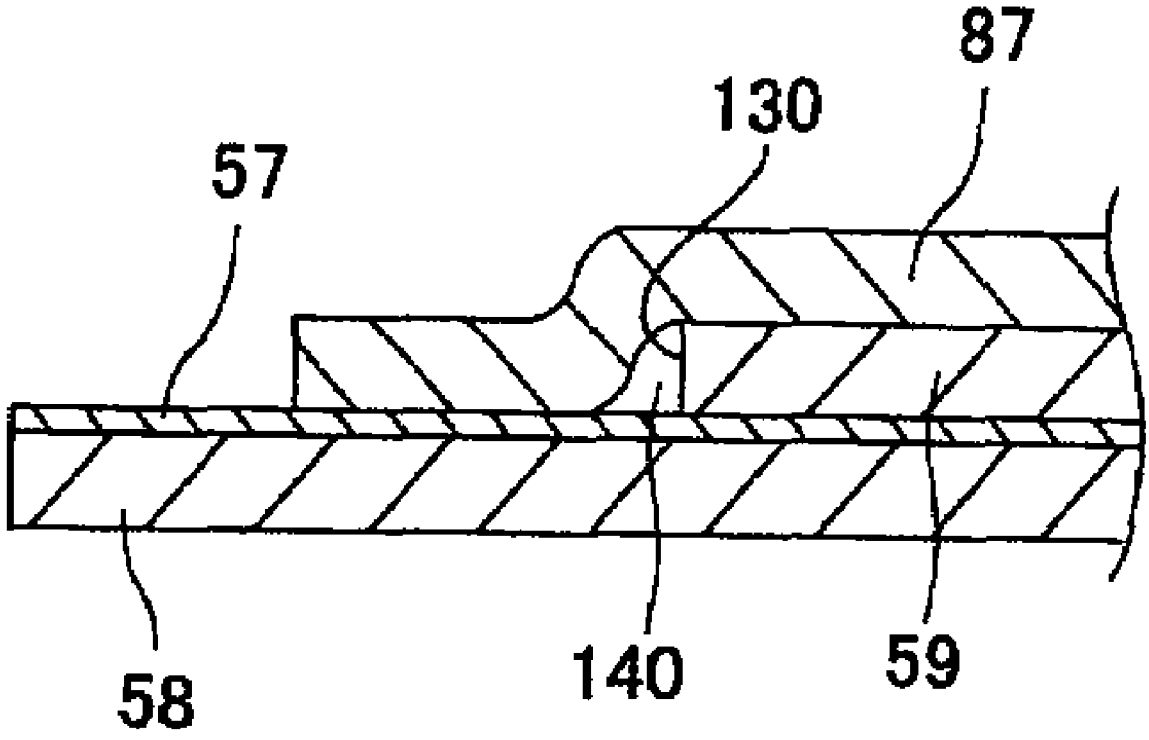
FIG. 15 is a sectional view showing the blade unit cut along the cutting-plane line A-A shown in FIG. 14.
Figure 16:
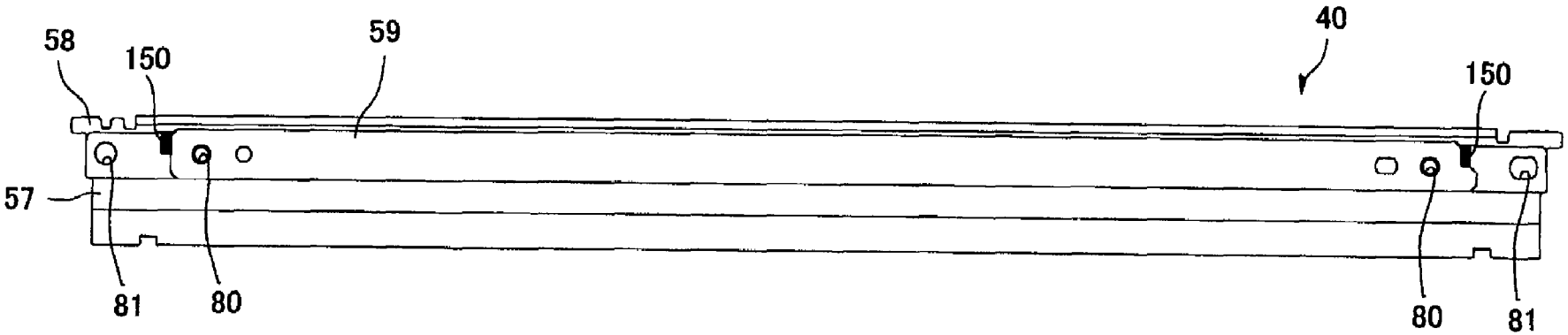
FIG. 16 is a front view showing a state where elastic adhesive is applied to longitudinal end portions of a reinforcing plate shown in FIG. 14.

In this case, since the connecting portion 89 is arranged on the reinforcing plate 59, a clearance 140 is generated at a step portion 130 formed by the reinforcing plate 59 and the leaf spring member 57 as shown in FIG. 15. Accordingly, elastic adhesive 150 is applied to the step portion 130 as shown in FIG. 16 in order to prevent leakage of toner from this clearance 140.

In the present example, the Super X (manufactured by Cemedine Co., Ltd., registered trademark) is used as the elastic adhesive 150. For bonding the blade back seal 87 and the leaf spring member 57 and reinforcing plate 59 with the Super X, it is preferable to apply the Super X to the longitudinal end portions of the reinforcing plate 59 as shown in FIG. 16, leaving the same to stand for 10 minutes, and then bonding the respective members in a semidry state. Thus, detachment of the developing cartridge 26 for recycling becomes easy in comparison with a case where the Super X is applied to the end portions of the reinforcing plate 59 and left to stand for a few minutes (2 minutes, for example) and then the blade unit 40 and the blade back seal 87 are bonded, and it is possible to enhance the recyclability. (Second Embodiment: First Example)

Figure 17:
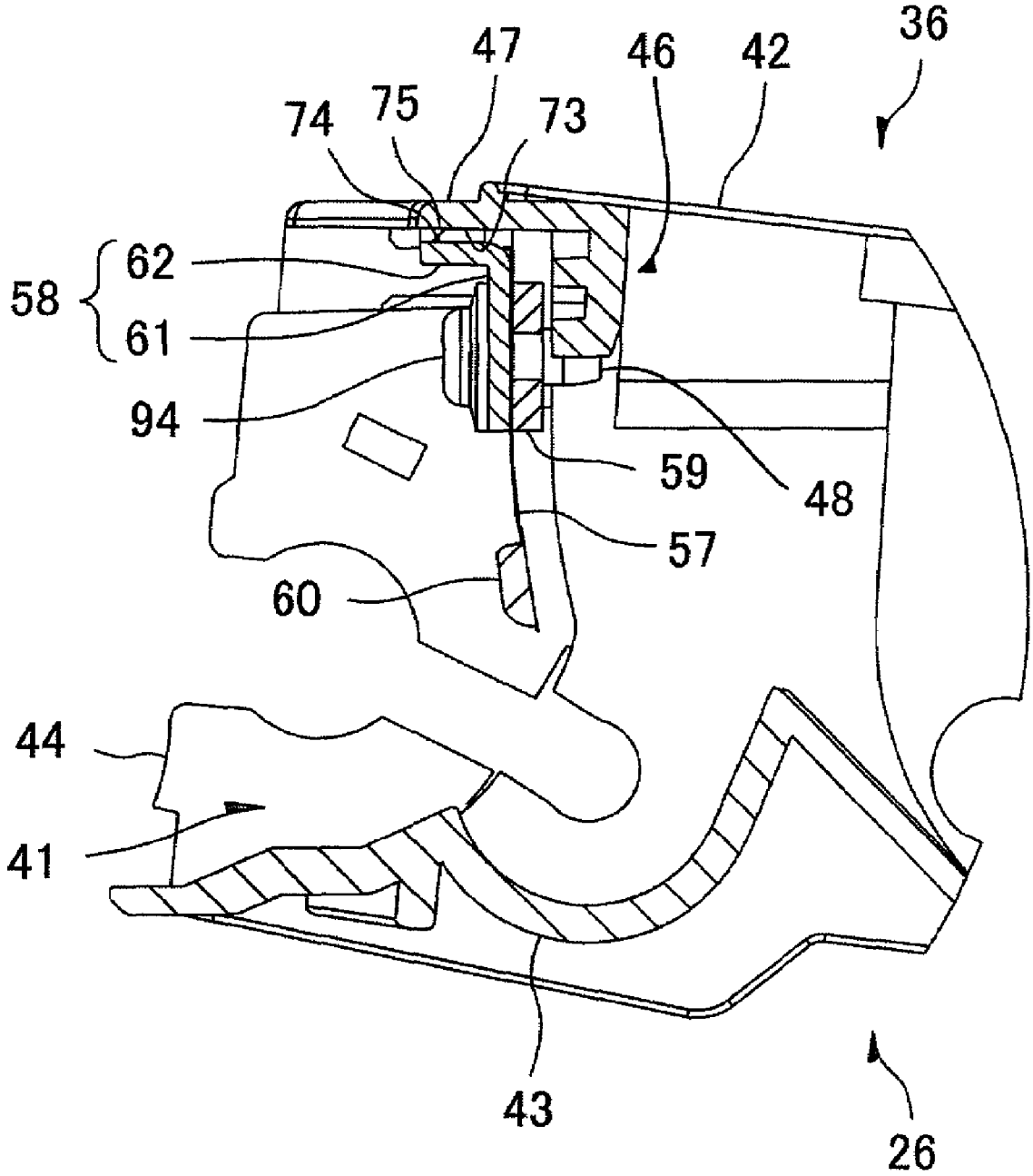
FIG. 17 is a sectional side view showing the structure around a blade unit of a developing cartridge (Second Embodiment: First Example)

As shown in FIG. 17, at the developing cartridge 26, an upper seal 75 is interposed between a lower face 73, which functions as a first opposed face of the upper attachment portion 47 that functions as a first wall portion of the blade attachment member 46, and an upper face 74, which functions as a second opposed face of the extended portion 62 of the bend preventing member 58 that functions as a first supporting member, as a first sealing member for sealing the space there between.

Figure 18:
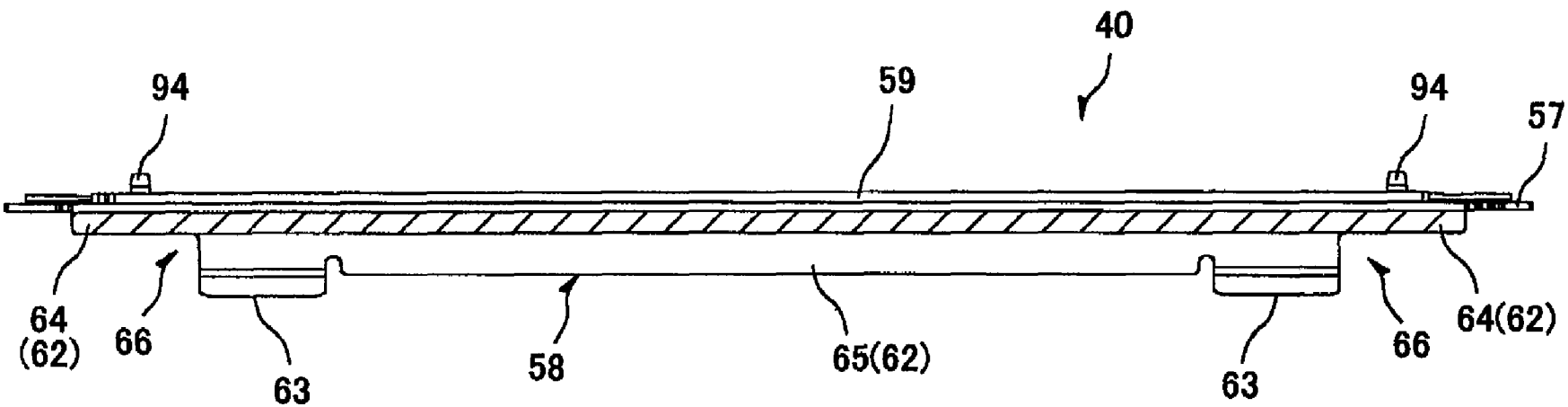
FIG. 18 is a plan view showing the application position of an upper seal of the developing cartridge (Second Embodiment: First Example)

The upper seal 75 is made of sponge material such as urethane foam, and is formed to have an elongated rectangular plate like shape. This upper seal 75 has a width in the longitudinal direction set equal to the width in the longitudinal direction of the extended portion 62 of the bend preventing member 58 and a width in the anteroposterior direction set slightly smaller than the first width of the end extended portions 64, is arranged over the longitudinal entire area of the extended portion 62 along the front edge of each end extended portion 64 as shown by hutching in FIG. 18 and is applied by two-sided tape or the like. Moreover, in a state before the blade unit 40 is attached to the blade attachment member 46, the upper seal 75 has a thickness larger than the distance between the lower face 73 of the upper attachment portion 47 and the upper face 74 of the extended portion 62 of a state where the blade unit 40 is attached to the blade attachment member 46.

Thus, the upper seal 75 is compressed inward in the opposed direction of the upper attachment portion 47 and the extended portion 62 when the blade unit 40 is attached to the blade attachment member 46 and elastically presses the upper attachment portion 47 and the extended portion 62 respectively, so that it is possible to reliably seal the space between the upper attachment portion 47 and the extended portion 62 over the longitudinal entire area of the extended portion 62. It is therefore possible to prevent toner which enters the back surface of the leaf spring member 57 and runs round from the back surface to the upper end portion of the leaf spring member 57 from leaking from between the upper attachment portion 47 and the extended portion 62.

Moreover, since the upper seal 75 is interposed between the upper attachment portion 47 and the extended portion 62, a sufficient width in the longitudinal direction can be ensured for the upper seal 75 even when the dimension of the blade unit 40 is decreased heightwise in order to decrease the dimension of the developing cartridge 26 heightwise (in the vertical direction). It is therefore possible to ensure sufficient sealing performance by the upper seal 75, to reliably prevent leakage of toner from between the upper attachment portion 47 and the extended portion 62 and to downsize the developing cartridge 26.

Furthermore, since the lower face 73 of the upper attachment portion 47 and the upper face 74 of the extended portion 62 have width in the anteroposterior direction, it is possible to set the width in the anteroposterior direction of the upper seal 75 large, to enhance the sealing performance by the upper seal 75 and to prevent toner leakage from between the upper attachment portion 47 and the extended portion 62 more reliably.

Since the contact portion 61 and the extended portion 62 of the bend preventing member 58 are formed in succession in a curved manner, it is possible to give relatively high rigidity to the bend preventing member 58. It is therefore possible to prevent flexion such as deflection or undulation of the leaf spring member 57 by making the contact portion 61 of the bend preventing member 58 in contact with the back surface (face at the back side) of the leaf spring member 57 and supporting the leaf spring member 57 by the bend preventing member 58. As a result, it is possible to press the pressing member 60 to the roller 56 of the developing roller 39 with uniform force by the elastic force of the leaf spring member 57 and to retain a thin layer of toner having a uniform thickness on the surface of the roller 56. Moreover, since the upper face 74 of the extended portion 62 functions also as the interposition face of the upper seal 75, a member for holding the upper seal 75 with the upper attachment portion 47 of the blade attachment member 46 does not need to be provided in addition and it is possible to reduce the number of components.

Furthermore, since the process cartridge 18 comprises the developing cartridge 26 capable of reliably preventing leakage of toner even when the dimension of the blade unit 40 is decreased heightwise, it is possible to downsize the process cartridge 18 and to downsize the laser printer 1 corresponding to the downsizing of the process cartridge 18.(Second Embodiment: Second Example)

Figure 19:
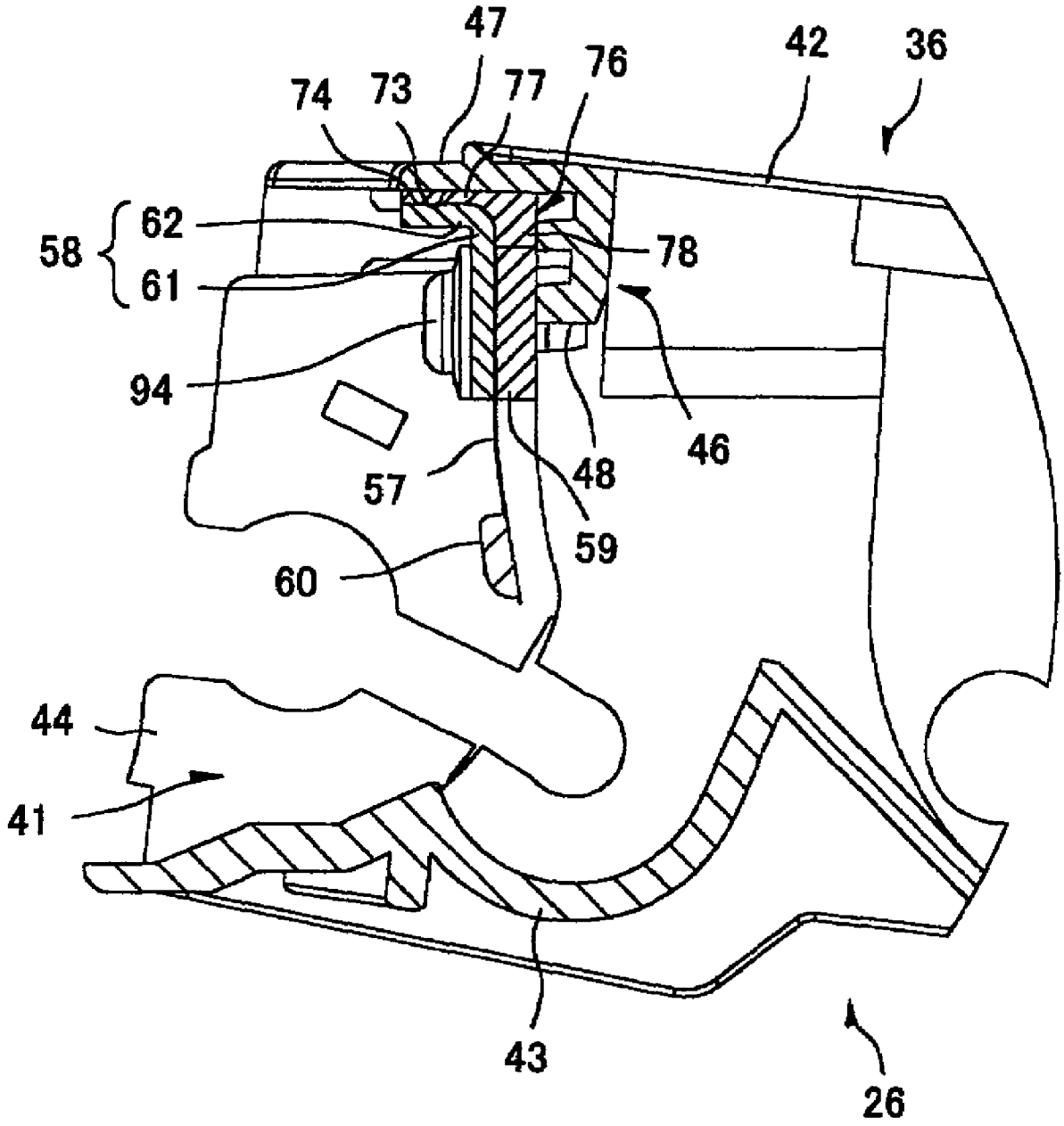
FIG. 19 is an essential part sectional side view of a developing cartridge (Second Embodiment: Second Example)

FIG. 19 is an essential part sectional side view showing another example of the developing cartridge 26. It should be noted that like codes are used in FIG. 19 to refer to portions corresponding to the above portions and explanation thereof will be omitted.

Figure 20:
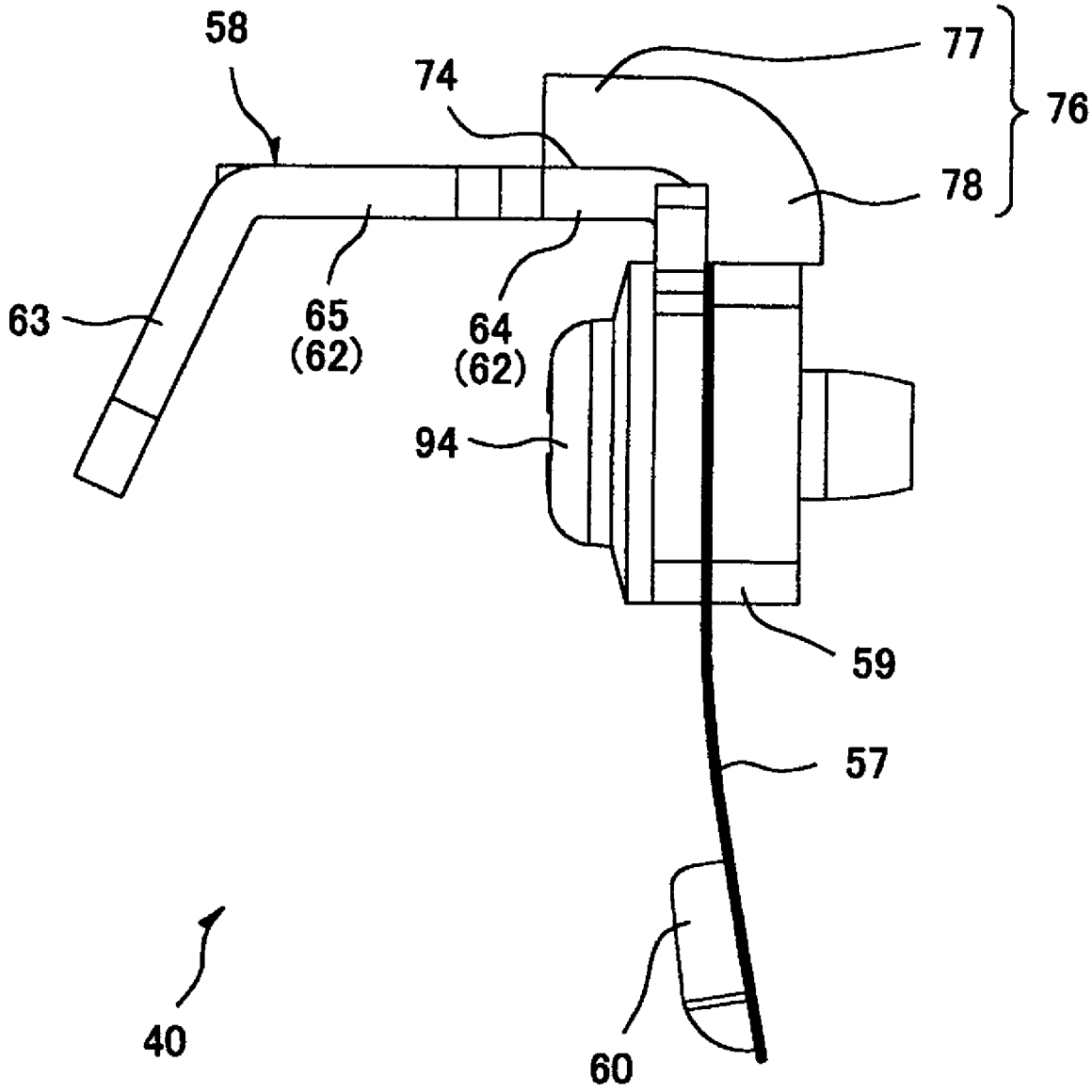
FIG. 20 is a sectional side view showing a state where an upper seal is applied at the developing cartridge (Second Embodiment: Second Example)

In this developing cartridge 26, an upper seal 76 to be interposed between the upper attachment portion 47 of the blade attachment member 46 and the extended portion 62 of the bend preventing member 58 is formed to run round from between the upper attachment portion 47 and the extended portion 62 to the space between the front attachment portion 48, which functions as a second wall portion, and the contact portion 61 of the bend preventing member 58. The upper seal 76 is made of sponge material such as urethane foam, and integrally comprises a seal upper portion 77, which functions as a first sealing member to be arranged at the upper face 74 of the extended portion 62, and a seal front portion 78, which functions as a second sealing member to be arranged at the back surface side of the leaf spring member 57, as shown in FIG. 20. The seal upper portion 77 is applied to the upper face 74 and the seal front portion 78 is applied to the contact portion 61 respectively by two-sided tape or the like.

Similarly to the upper seal 75 described above, the seal upper portion 77 is arranged over the longitudinal entire area of the extended portion 62 along the front edge of the end extended portions 64, and has a thickness larger than the distance (see FIG. 19) between the upper attachment portion 47 and the extended portion 62 of a state where the blade unit 40 is attached to the blade attachment member 46, in a state before the blade unit 40 is attached to the blade attachment member 46. The seal front portion 78 is formed in succession from the seal upper portion 77 and extends to the position where the same comes in contact with the upper end face of the reinforcing plate 59 which functions as a second supporting member. In a state before the blade unit 40 is attached to the blade attachment member 46, this seal front portion 78 has a thickness larger than the distance between the leaf spring member 57 and the front attachment portion 48, i.e. the thickness in the anteroposterior direction of the reinforcing plate 59, of a state where the blade unit 40 is attached to the blade attachment member 46.

The blade unit 40 is attached to the blade attachment member 46 so that the seal upper portion 77 is pressed to the upper attachment portion 47 by the extended portion 62 of the bend preventing member 58, the reinforcing plate 59 comes in contact with and is opposed to the front attachment portion 48 and the seal front portion 78 is pressed to the front attachment portion 48 by the contact portion 61 of the bend preventing member 58. Thus, the seal upper portion 77 is compressed in the opposed direction of the upper attachment portion 47 and the extended portion 62 and elastically presses the upper attachment portion 47 and the extended portion 62 respectively.

Moreover, the seal front portion 78 is compressed in the opposed direction of the front attachment portion 48 and the contact portion 61 of the bend preventing member 58 and elastically presses the front attachment portion 48 and the contact portion 61 respectively. It is therefore possible to reliably seal the space between the upper attachment portion 47 and the extended portion 62 by the seal upper portion 77 and to reliably seal the space between the front attachment portion 48 and the contact portion 61 of the bend reventing member 58 by the seal front portion 78. As a result, it is possible to prevent toner in the case 36 from entering the space between the front attachment portion 48 and the contact portion 61 of the bend preventing member 58 and to prevent leakage of toner from between the upper attachment portion 47 and the extended portion 62 further reliably.

Moreover, since the seal upper portion 77 and the seal front portion 78 are formed integrally, it is possible to reduce the number of components and the number of processes for attachment in comparison with a case where these members are formed separately. Furthermore, since the reinforcing plate 59 comes in contact with the front attachment portion 48 and the seal front portion 78 is arranged at a clearance between the lower face 73 of the upper attachment portion 47 and the upper end face of the reinforcing plate 59, the seal front portion 78 is not engaged between the reinforcing plate 59 and the front attachment portion 48 and it is possible to prevent generation of a clearance between the reinforcing plate 59 and the front attachment portion 48 and to ensure reliable sealing.

Figure 21:
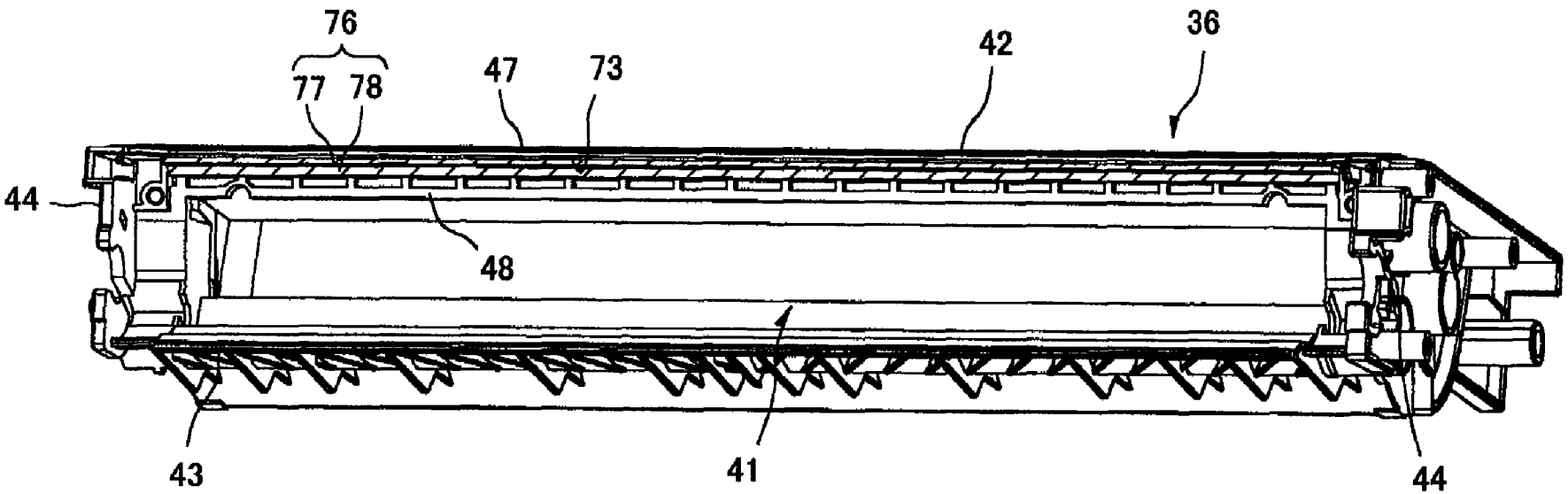
FIG. 21 is a perspective view showing a state where the upper seal is applied to a case of the developing cartridge (Second Embodiment: Second Example)

It should be noted that, although the upper seal 76 is applied to the blade unit 40 in this example, the upper seal 76 may applied to the blade attachment member 46 by two-sided tape or the like as shown in FIG. 21 and the blade unit 40 may be attached to the blade attachment member 46 to which the upper seal 76 is applied.

Figure 22A:
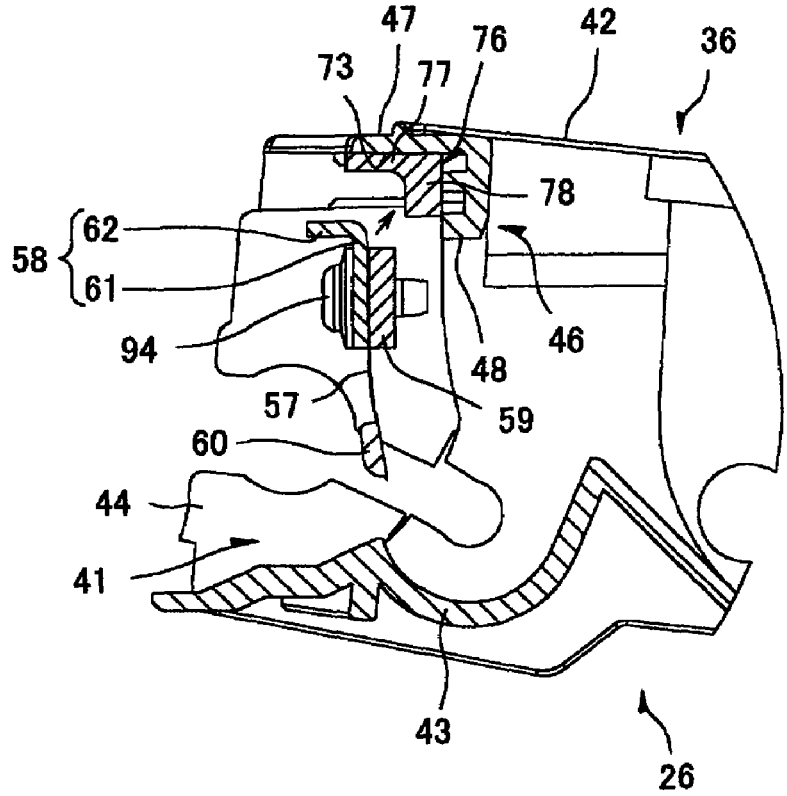
FIGS. 22A and 22B are sectional side views for explaining an attachment method of a blade unit to the case of the developing cartridge (Second Embodiment: Second Example).
Figure 22B:
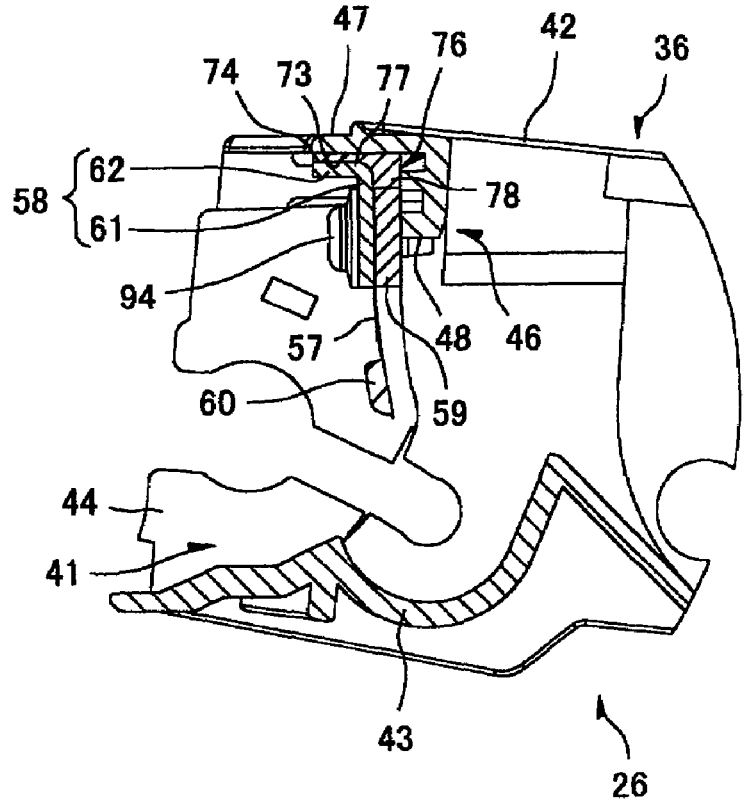

In this case, after the upper seal 76 is applied to the blade attachment member 46 as shown in FIG. 22A, the blade unit 40 is attached from obliquely below the back side of the upper seal 76 obliquely upward of the front side so that the seal upper portion 77 is pressed to the upper attachment portion 47 of the blade attachment member 46 by the extended portion 62 of the bend preventing member 58 and the seal front portion 78 is pressed to the front attachment portion 48 of the blade attachment member 46 by the contact portion 61 of the bend preventing member 58. With such attachment, it is possible to reliably make the reinforcing plate 59 in contact with the front attachment portion 48 without engaging the seal front portion 78 between the reinforcing plate 59 and the front attachment portion 48 as shown in FIG. 22B and to reliably arrange the seal front portion 78 between the lower face 73 of the upper attachment portion 47 and the upper end face of therein forcing plate 59.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A developing apparatus comprising:

a case having a slit-shaped opening and a holder, the holder being configured to communicate with the opening and to hold developer, the opening being formed in a longitudinal direction;

a first wall portion provided at an upper side of the opening, the first wall portion extending along a longitudinal direction of the opening and along a communication direction extending between the opening and the holder;

a second wall portion extending from the first wall portion in both the longitudinal direction and a height direction perpendicular to both the communication direction and longitudinal direction;

a developer retainer configured to retain the developer on a surface thereof, the developer retainer being arranged at the opening along the longitudinal direction of the opening and rotatably supported at the case;

a layer thickness regulating member comprising:

a blade, one end of which is arranged opposite to the first wall portion and the other end of which extends from the one end toward the surface of the developer retainer such that the other end is pressed against the surface of the developer retainer; and a first supporting member comprising:

a first supporting portion arranged opposite to the first wall portion, the first supporting portion extending in the communication direction; and a second supporting portion arranged opposite to the second wall portion, the blade being supported at the second supporting portion and extending in the height direction, the second supporting portion being integrally formed with the first supporting portion; and a first sealing portion interposed between the first wall portion and the first supporting portion, the first sealing portion being configured to seal a space between the first wall portion and the first supporting portion; and a second sealing portion interposed between the second wall portion and the second supporting portion, the second sealing portion being configured to seal a space between the second wall portion and the second supporting portion;

wherein the first sealing portion and the second sealing portion are formed integrally.

2. The developing apparatus according to claim 1, wherein the first wall portion is formed integrally with the case.

3. The developing apparatus according to claim 1, wherein the layer thickness regulating member further comprises a second supporting member, one face of which is in contact with the blade such that the blade is interposed between the second supporting portion of the first supporting member and the second supporting member, wherein the second sealing portion is in contact with the first wall portion and the second supporting member.

4. The developing apparatus according to claim 1, wherein the second wall portion is formed integrally with the case.

* * * * *